US008428503B2

(12) United States Patent
Sasamoto et al.

(10) Patent No.: US 8,428,503 B2
(45) Date of Patent: Apr. 23, 2013

(54) FIXING DEVICE AND IMAGE FORMING APPARATUS

(75) Inventors: Tetsurou Sasamoto, Kanagawa (JP); Takuma Nakamura, Kanagawa (JP); Masafumi Yamada, Kanagawa (JP); Yuichi Aoyama, Kanagawa (JP); Takanori Inadome, Kanagawa (JP); Kazuya Nagao, Kanagawa (JP); Shunichi Abe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 292 days.

(21) Appl. No.: 12/929,859

(22) Filed: Feb. 22, 2011

(65) Prior Publication Data

US 2011/0217099 A1 Sep. 8, 2011

(30) Foreign Application Priority Data

Mar. 4, 2010 (JP) ..... 2010-047844

(51) Int. Cl.
*G03G 15/20* (2006.01)

(52) U.S. Cl.
USPC ..... 399/340

(58) Field of Classification Search ..... 399/340
See application file for complete search history.

(56) References Cited

U.S. PATENT DOCUMENTS

| | | | |
|---|---|---|---|
| 5,666,628 | A | 9/1997 | Fukai |
| 7,655,374 | B2 | 2/2010 | Katano et al. |
| 7,713,673 | B2 | 5/2010 | Katano et al. |
| 2007/0243483 | A1 | 10/2007 | Katano et al. |
| 2008/0063446 | A1 | 3/2008 | Katano et al. |
| 2008/0069612 | A1 | 3/2008 | Nakamura et al. |
| 2008/0213002 | A1 | 9/2008 | Katano et al. |
| 2009/0003903 | A1 | 1/2009 | Katano et al. |
| 2009/0067904 | A1 | 3/2009 | Katano et al. |
| 2011/0158691 | A1 * | 6/2011 | Foster et al. ..... 399/122 |

FOREIGN PATENT DOCUMENTS

| | | | |
|---|---|---|---|
| EP | 2009515 | | 12/2008 |
| JP | 59119364 | A | 7/1984 |
| JP | 3290513 | B | 3/2002 |
| JP | 4185742 | B | 9/2008 |
| JP | 2009008967 | A | 1/2009 |
| JP | 2010-032660 | | 2/2010 |
| JP | 2011008107 | A | 1/2011 |

OTHER PUBLICATIONS

Search Report dated Jun. 22, 2011 issued in corresponding European Application No. 11155701.3.
Abstract of Japanese Patent Publication No. JP2004-109749, published on Apr. 8, 2004.
Patent Abstracts of Japan; JP 2011-008107, published Jan. 13, 2011.

* cited by examiner

*Primary Examiner* — G. M. Hyder
(74) *Attorney, Agent, or Firm* — Harness, Dickey & Pierce, P.L.C.

(57) ABSTRACT

A disclosed fixing device for fixing resin particles softened by applying a foam fixer thereon to a recording medium includes a foam fixer generator unit to introduce air bubbles into a liquid fixer containing a softener for softening the resin particles by dissolving or swelling a part of the resin particles to generate the foam fixer, a fixer application member to be brought into contact with a facing member facing the fixer application member to form an application nip and transfer the generated foam fixer to the application nip by moving its surface while carrying the foam fixer to apply the foam fixer to a surface of the recording medium carrying the resin particles at the application nip, and a foam accumulation detector unit to detect a foam accumulation formed of the foam fixer accumulated at an entrance side of the application nip.

15 Claims, 11 Drawing Sheets

FIXING DEVICE AND IMAGE FORMING APPARATUS

BACKGROUND OF THE INVENTION

1. Field of the Invention

The invention relates to an image forming apparatus such as a copier, a facsimile machine and a printer, and a fixing device suitable for use in such an image forming apparatus. More specifically, the invention relates to a fixing device configured to apply a fixer to resin particles on a fixing medium subject to image fixation or a resin particle carrier subject to image fixation by dissolving or swelling at least a part of the resin particles such as toner, and also to an image forming apparatus including such a fixing device.

2. Description of the Related Art

Image forming apparatuses such as printers, facsimile machines and copiers are generally configured to form images including characters or symbols on fixing media such as paper, cloth, and OHP sheets based on image information. There are various types of image forming apparatuses; however, among these, electrophotographic image forming apparatuses are widely used in office environments because the electrophotographic image forming apparatuses are capable of forming high definition images on plain paper at high speeds. In such electrophotographic image forming apparatuses, a fixing device that employs a thermal fixing system is widely used. In the fixing device employing the thermal fixing system, toner onto a fixing medium such as a recording medium is melted or softened by heating, and the softened toner is then pressed on the recording medium. Accordingly, the toner is fixed on the recording medium. The fixing device employing the thermal fixing system (hereinafter also called a "thermal fixing device") is suitable for use in the electrophotographic image forming apparatus because it may provide high fixing speeds and high fixing image qualities.

However, more than half of the power is consumed for heating toner in the electrophotographic image forming apparatus having the thermal fixing device. Meanwhile, in view of recent environmental issues, there are increasing demands for low-power consumption (energy conservation) image forming apparatuses. With the low-power consumption image forming apparatus, the power consumed by the fixing device is preferably reduced down to half of the power consumption of the related art image forming apparatuses. Since the related art thermal fixing device is configured to consume a large amount of energy for heating (heating process), there is an increasing demand for a fixing device having a fixing system capable of heating toner to be fixed to the recording medium at an extremely low temperature or capable of fixing toner to the recording medium without heating the toner. In particular, it is ideal to provide a fixing device employing a non-thermal fixing system (hereinafter also called a "non-thermal fixing device") capable of fixing toner to the recording medium without heating toner in terms of low power consumption. Japanese Patent No. 3290513 (hereinafter referred to as "Patent Document 1"), Japanese Patent No. 4185742 (hereinafter referred to as "Patent Document 2"), Japanese Patent Application Publication No. 59-119364 (hereinafter referred to as "Patent Document 3"), and Japanese Patent Application Publication No. 2009-008967 (hereinafter referred to as "Patent Document 4") disclose examples of the non-thermal fixing device, that is, a fixing device with a wet fixing system (hereinafter also called a "wet fixing device"). The wet fixing device is configured to apply a fixer containing a softener for softening toner by dissolving or swelling at least a part of a resin component of the toner on a toner image formed on a surface of a recording medium to fix the toner image on the recording medium. In the wet fixing device, since heating is not required for softening the toner, it is possible to save more energy in comparison to the thermal fixing device.

In the configuration of any one of the fixing devices disclosed in Patent Documents 1 to 3, an application roller that is a contact-type fixer application unit is configured to apply a liquid fixer to an unfixed toner image formed on a fixer application target such as a recording medium or an intermediate transfer member to fix the toner image to the fixer application target. In the above configuration, where the toner image is fixed to the recording medium using the liquid fixer, it may be difficult to apply a small amount of the liquid fixer to the toner image on the recording medium while simultaneously preventing the offset of the toner onto the application roller. The difficulty is described in detail below.

If the thickness of a liquid fixer layer applied on the application roller is made less than the thickness of the unfixed toner image in order to apply a small amount of the liquid fixer to the unfixed toner image on the recording medium in the above configuration where the liquid fixer is applied to the unfixed toner image on the recording medium by the application roller, the following difficulties may be involved. Toner particles in the toner layer of the toner image on the recording medium are attracted due to surface tension of an unapplied, remaining liquid fixer film on the application roller at a position where the surface of the application roller is detached from the toner image on the recording medium after the surface of the application roller is brought into contact with the toner image on the recording medium. Accordingly, the offset toner particles on the surface of the application roller may be attached to the toner image on the recording medium when the application roller has been detached from the toner image on the recording medium, thereby degrading the toner image on the recording medium.

If, on the other hand, the liquid fixer on the application roller is made sufficiently thicker than the unfixed toner layer on the recording medium, the surface tension of the liquid fixer film on the application roller may not sufficiently act on the toner particles of the toner layer of the toner image at a position where the surface of the application roller is detached from the toner image on the recording medium after the surface of the application roller is brought into contact with the toner image on the recording medium due to too much of the liquid fixer on the application roller. In this manner, although few toner particles are attached to the surface of the application roller, a large amount of liquid fixer is applied to the toner image on the recording medium. Thus, image quality of the toner image may be degraded due to toner particles flowing in the over-applied liquid fixer dispersed over the toner image on the recording medium, fixing responsiveness may be degraded due to prolonged drying time of the liquid fixer. Further, a user may feel residual liquid (i.e., wet feeling of touch when touching paper with bare hands). Moreover, if the liquid fixer contains water and if a large amount of the liquid fixer is applied to the recording medium such as paper containing cellulose, the recording medium such as paper may be severely curled, which may cause paper jamming during the recording medium transfer inside an apparatus such as an image forming apparatus.

Thus, in the above configuration where the liquid fixer is applied to the toner image on the recording medium by the application roller, image degradation due to toner particle flow, low fixing responsiveness due to prolonged drying time of the liquid fixer, or paper jamming due to cellulose of paper may be obtained. If on the other hand, a small amount of the liquid fixer is applied to the toner image on the recording medium in order to prevent the above case, the toner particles may be transferred and attached to the surface of the application roller as described above. Thus, in the configuration where the liquid fixer is applied to the toner image on the recording medium by the application roller, it may be difficult to apply a small amount of the liquid fixer to improve the fixing responsiveness, lower the residual liquid feeling or prevent the recording medium from curling while simultaneously preventing the toner particles from being transferred to the application roller.

Japanese Patent Application Publication No. 2009-008967 discloses (hereinafter called "Patent Document 4") another example of the fixing device having the non-thermal fixing system capable of applying a small amount of a fixer to a toner image on a recording medium while simultaneously preventing the transfer (offset) of toner particles onto the application roller. The fixing device disclosed in Patent Document 4 further includes a foam fixer forming device configured to generate a foam fixer by dispersing air voids in a liquid fixer and the generated foam fixer is applied on the toner image formed on a recording medium. With this configuration, since the fixer is foam, particle (toner) density of the fixer may be reduced. Thus with this non-thermal fixing system, the film thickness of the fixer on an application roller may be increased with an amount of the fixer less than that of the related art liquid fixer. As a result, it may be possible to reduce an adverse effect of liquid surface tension on the toner particles on the recording medium. Further, since the amount of the fixer applied to the toner image on the recording medium is small, residual liquid feeling of the recording medium may be reduced. Further, since the foam fixer does not easily flow compared to the liquid fixer, image degradation due to toner particles flowing in the fixer may also prevented. Thus, the toner image may be fixed with the amount of the fixer less than that of the related art fixer without degradation if the toner image is fixed with the foam fixer as described in Patent Document 4.

The fixer device disclosed in Patent Document 4 includes a pressure roller configured to be brought into contact with the application roller to form an application nip, through which the recording medium is passed while the foam fixer on the application roller is applied onto the toner image on the recording medium. However, in the above fixing system where the foam fixer is applied by the application roller, the foam fixer may accumulate around an entrance of the application nip.

If the recording medium carrying an unfixed toner image on its surface is transferred to the entrance of the application nip where the foam fixer is accumulated, the recording medium is brought into contact with the accumulated foam fixer before being inserted into the application nip. When the recording medium is brought into contact with the accumulated foam fixer, a portion of a surface layer of the unfixed toner image on the recording medium is dissolved in the accumulated foam fixer and the portion dissolved into the accumulated foam fixer is detached from the toner image on the recording medium and transferred to the application roller. Further, in the configuration where the foam fixer is applied, the amount of the foam fixer carried on the application roller is adjusted such that a small amount of the liquid fixer is applied to the toner image on the recording medium while simultaneously preventing toner from being transferred (offset) to the application roller. However, if the foam fixer is accumulated around the entrance of the application nip, too much of the foam fixer may be applied to the toner image on the recording medium, thereby degrading image quality caused by image flowage due to applying too much of the foam fixer. Further, if the accumulated foam fixer (i.e., foam accumulation) is increased around the entrance of the application nip, the accumulated foam fixer may prevent the recording medium from being inserted (transferred) into the application nip, which may cause recording media jamming.

Note that an application member used as a contact-type fixer application unit configured to apply the foam fixer to a fixer application medium is not limited to the application roller and may be a belt type member. Note that an application member used as a contact-type fixer application unit configured to apply the foam fixer to a fixer application medium is not limited to the application roller and may be a belt type member. The foam fixer accumulation around the entrance of the application nip may occur in any configuration where the foam fixer is applied to the toner image on the recording medium at the application nip where the surface moving application member is brought into contact with another member. Further, as an example of the fixing device to fix the toner image to the recording medium using the foam fixer, there is provided a fixing device configured to apply the foam fixer to a toner image carrier member such as an intermediate transfer belt configured to carry the toner so as to simultaneously transfer the toner image and the foam fixer applied to the toner image on the toner image carrier member to the toner carrier member. As described above, even if the fixing device applies the foam fixer not to the toner image on the recording medium but to the toner image on the toner image carrier member, image degradation due to the foam fixer accumulated around the application nip may occur insofar as the configuration of the fixing device forms the application nip. Note that the image degradation due to the foam fixer accumulated around the application nip may occur insofar as the foam fixer is applied to any resin-containing particles to fix the toner image to the recording medium.

SUMMARY OF THE INVENTION

It is a general object of at least one embodiment of the present invention to provide a fixing device capable of fixing a toner image on the recording medium and an image forming apparatus having such a fixing device that substantially eliminates one or more problems caused by the limitations and disadvantages of the related art.

According to one embodiment, there is provided a fixing device for fixing resin particles softened by applying a foam fixer on the resin particles to a recording medium. The fixing device includes a foam fixer generator unit configured to introduce air bubbles into a liquid fixer containing a softener for softening the resin particles by dissolving or swelling a part of the resin particles to generate the foam fixer; a fixer application member configured to be brought into contact with a facing member facing the fixer application member to form an application nip between the fixer application member and the facing member, and transfer the foam fixer generated by the foam fixer generator unit to the application nip by moving a surface thereof while carrying the foam fixer on the surface thereof to apply the foam fixer to a surface of the recording medium carrying the resin particles or a surface of a resin particle carrying member carrying the resin particles at the application nip; and a foam accumulation detector unit configured to detect a foam accumulation formed of the foam fixer accumulated at an entrance side of the application nip.

According to another embodiment, there is provided an image forming apparatus that includes a toner image forming unit configured to form a toner image on a surface of a recording medium by utilizing toner containing resin particles composed of resin and colorant; and the fixing device employed as a fixing unit configured to apply a foam fixer on the surface of the recording medium that carries the toner image to fix the toner image on the recording medium.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 2:
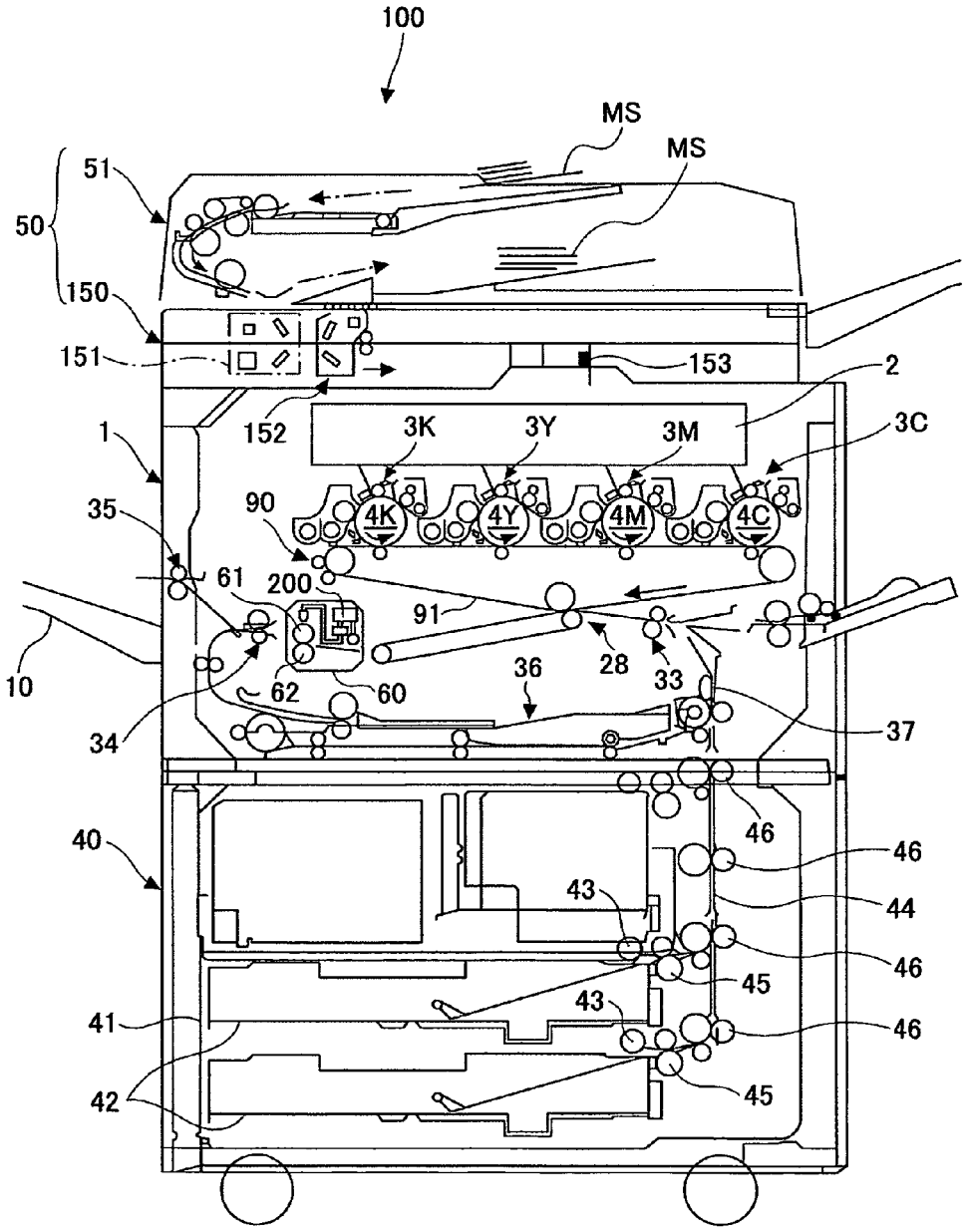
FIG. 2 is a schematic diagram illustrating a copier according to the first embodiment.

In the following, embodiments of the present invention will be described with reference to the accompanying drawings. Note that an image forming apparatus including features of the embodiments is described as a copier; however, the image forming apparatus may be other image forming apparatuses such as a printer and a facsimile machine. First, a basic configuration of a copier 100 according to the embodiments is described. FIG. 2 is a schematic configuration diagram illustrating the copier 100. The copier 100 includes a printer section 1, a sheet feeder 40, and a document transfer-reader unit 50. The document transfer-reader unit 50 includes a scanner section 150 fixed on the printer section 1 provided as a document reader, and an automatic document feeder (ADF) 51 supported by the scanner section 150.

The sheet feeder 40 includes two sheet cassettes 42 arranged in a multi-stage paper bank 41, and sheet feeder rollers 43 configured to feed respective transfer sheets P from the sheet cassettes 42. The sheet feeder 40 further includes sheet separation rollers 45 each configured to separate a top transfer sheet from the rest of the transfer sheets P (see FIG. 3) transferred from the sheet cassettes 42 to supply the top transfer sheet to a sheet feeder path 44. The sheet feeder 40 still further includes plural transfer rollers 46 configured to transfer the transfer sheet P to a sheet transfer path 37 in the printer section 1. With this configuration, the transfer sheets P contained in the sheet cassettes 42 are transferred to the sheet transfer path 37 in the printer section 1.

The scanner section 150 located above the printer section 1 includes a fixed reader section 151 and a moving reader section 152 as a reading unit to read an image of a document MS. The fixed reader section 151 having an image reading sensor 153 including a light source, reflecting mirrors, and a CCD is arranged immediately beneath a not-shown first contact glass fixed on an upper wall of a casing of the scanner section 150 such that the fixed reader section 151 is brought into contact with the document MS. Thus, when the document MS transferred by the ADF 51 passes through to the first contact glass, and light emitted from the light source sequentially reflects off a surface of the document MS, the image reading sensor 153 receives the light via the reflecting mirrors. The fixed reader section 151 scans the document MS without using an optical system composed of the light source and the reflecting mirrors in this manner.

The moving reader section 152 is arranged immediately beneath a not-shown second contact glass fixed on the upper wall of the casing of the scanner section 150 and illustrated on the right hand side of the fixed reader section 151 in FIG. 2. The moving reader section 152 may move the optical system composed of the light source and the reflecting mirrors in a horizontal direction in FIG. 2. The moving reader section 152 allows the light emitted from the light source to reflect off the document MS residing on the second contact glass while the moving reader section 152 moves the optical system from left to right in FIG. 2. The light reflected off the document MS is then received by the image reading sensor 153 via the reflecting mirrors. The moving reader section 152 scans the document MS while moving the optical system composed of the light source and the reflecting mirrors in this manner. In the copier 100, the scanner section 150 scans the document MS and the image reading sensor 153 acquires image information. The copier 100 further includes an optical writing device 2 in which laser light L (see FIG. 3) is emitted from the light source toward four photoreceptor drums 4K, 4Y, 4M, and 4C by driving the light source.

Figure 3:
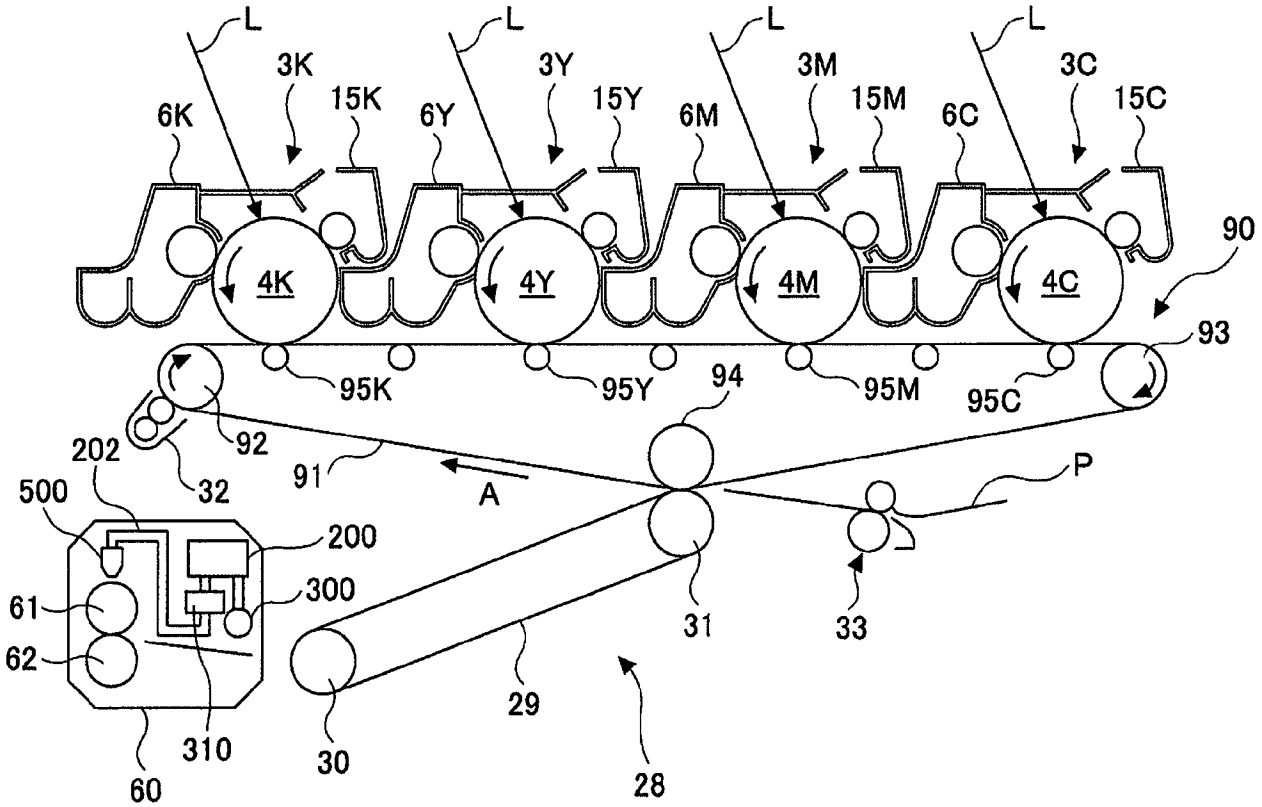
FIG. 3 is a partially enlarged diagram illustrating a portion of an internal configuration of a printer section of the copier according to the first embodiment.

FIG. 3 is a partially enlarged diagram illustrating a portion of an internal configuration of the printer section 1 of the copier 100. As illustrated in FIG. 2, the printer section 1 includes four image forming units 3K, 3Y, 3M, and 3C configured to form toner images in colors of black (K), yellow (Y), magenta (M), and cyan (C), an image transfer unit 90, a sheet transfer unit 28, a resist roller pair 33, and a fixing device 60. The laser light L is emitted toward the four photoreceptor drums 4K, 4Y, 4M, and 4C by driving the not shown light source such as a laser diode or LED arranged inside the optical writing device 2 based on the image information described above. Upon exposure to laser light, latent images are formed on surfaces of the photoreceptor drums 4K, 4Y, 4M, and 4C, and the latent images are eventually developed to form toner images via a predetermined development process. Note that subscripts K, Y, M, and C provided after reference numerals in the drawings indicate the components are specified for respective colors of black, yellow, magenta, and cyan.

The image forming units 3K, 3Y, 3M and 3C include the photoreceptor drums 4K, 4Y, 4M, and 4C used as the latent image carriers and other respective peripherals. The image forming units 3K, 3Y, 3M and 3C having the photoreceptor drums 4K, 4Y, 4M, and 4C, and the other peripherals are supported on corresponding common supporting members to be provided as units. Thus, each of the image forming units 3K, 3Y, 3M and 3C including the photoreceptor drums 4K, 4Y, 4M, and 4C and the peripherals is detachably attached to a main body of the printer 100. For example, the black image forming unit 3K includes the photoreceptor drum 4K and a developing device 6K configured to develop the latent image formed on the surface of the photoreceptor drum 4K to form the black toner image. The black image forming unit 3K further includes a black photoreceptor cleaning device 15K configured to remove residual transfer toner from the surface of the black photoreceptor drum 4K that has passed through a (black) primary transfer nip portion. The copier 100 includes a tandem configuration, in which the four image forming units 3K, 3Y, 3M and 3C are arranged such that the four image forming units 3K, 3Y, 3M and 3C face an intermediate transfer belt 91 described later in an endless travel direction of an intermediate transfer belt 91.

Figure 4:
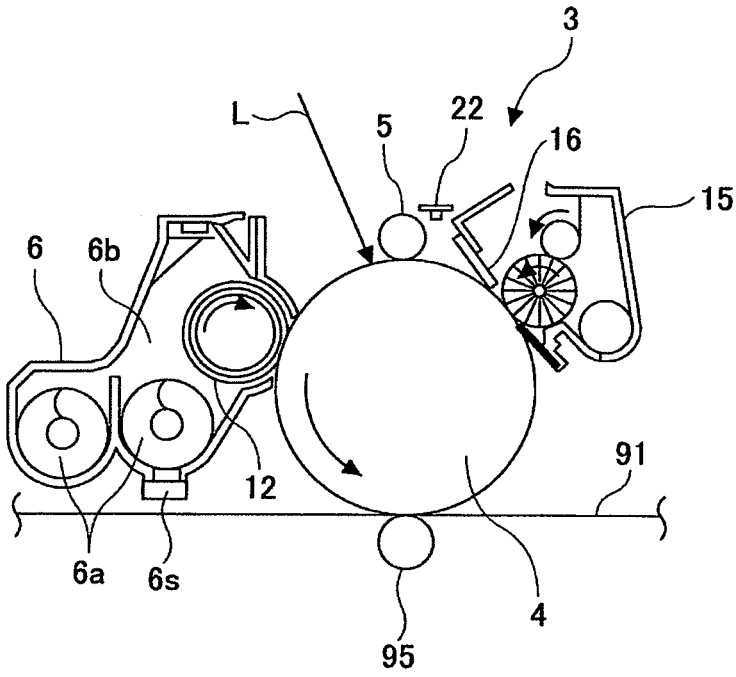
FIG. 4 is a partially enlarged diagram illustrating one of four image forming units in the copier according to the first embodiment.

FIG. 4 is a partially enlarged diagram illustrating one of the four image forming units 3K, 3Y, 3M and 3C in the copier 100. Note that since the image forming units 3K, 3Y, 3M and 3C include almost the same configurations, the subscripts K, Y, M, and C provided after the reference numerals are omitted in FIG. 4. As illustrated in FIG. 4, the image forming unit 3 includes a charging roller 5 of a charging device, a developing device 6, a photoreceptor cleaning device 15 and a static eliminator lamp 22 of a static eliminator device arranged in the periphery of a photoreceptor drum 4.

In the copier 100, the photoreceptor drum 4 is formed of an aluminum tube coated with a photoreceptor layer made of an organic photoreceptor material. Note that the photoreceptor drum 4K may be an endless belt type photoreceptor.

The developing device 6 includes a developing roller 12 that is a developer carrier configured to carry a two-component developer containing a magnetic carrier and non-magnetic toner. The developing roller 12 supplies toner to the latent image on the photoreceptor drum 4 in a developing region that is a facing portion between the developing roller 12 and the photoreceptor drum 4, where the latent image is developed into a visible image. The developing device 6 further includes a developer container 6*b* configured to contain the two-component developer supplied to the surface of the developing roller 12. The developer container 6*b* includes stirrer screws 6*a* as a stir-transfer member configured to transfer the two-component developer with stirring.

The developing roller 12 includes a rotationally arranged non-magnetic tubular developing sleeve and a magnetic roller non-rotationally arranged inside the developing sleeve. The magnetic roller includes magnetic poles sequentially arranged in a rotational direction of the developing sleeve. The magnetic poles apply a magnetic attraction force to the two-component developer on the developing sleeve at predetermined positions in the rotational direction of the developing sleeve. The magnetic attraction force applied from the magnetic poles causes the two-component developer contained in the developer container 6*b* to be attracted to the surface of the developing sleeve such that the two-component developer is carried on the surface of the developing sleeve. The magnetic attraction force also forms a magnetic brush along magnetic field lines on the surface of the developing sleeve.

The magnetic brush is controlled to have an appropriate layer thickness at a facing position between the magnetic brush and a not shown developer control member while the developing sleeve is rotated, and the magnetic brush having the appropriate layer thickness is then transferred to the developing region. Toner is then moved onto the latent image to develop a toner image by the potential difference between developing bias applied to the developing sleeve and the latent image on the photoreceptor drum 4. Further, after passing through the developing region and returning to the inside the developing device 6, the two-component developer that forms the magnetic brush comes off of the surface of the developing sleeve, due to an effect of repulsive magnetic fields formed between the magnet poles of the magnet roller. The two-component developer that comes off of the surface of the developing sleeve is returned to the developer container 6*b*. A toner concentration sensor 6*s* is arranged inside the developer container 6*b*. A not-shown toner supply device is controlled based on the detected result of the toner concentration sensor 6*s*. Accordingly, the toner supply device supplies an appropriate amount of toner into the developer container 6*b* such that the two-component developer in the developer container 6*b* has a predetermined range of toner concentration.

As illustrated in FIG. 3, four color K, Y, M, and C toner images are formed on the surfaces of the photoreceptor drums 4K, 4Y, 4M, and 4C of the image forming units 3K, 3Y, 3M, and 3C by conducting the above-described image forming processes.

As illustrated in FIG. 3, the image transfer unit 90 is arranged beneath the four image forming units 3K, 3Y, 3M and 3C. The image transfer unit 90 includes the intermediate transfer belt 91 tightened by first, second and third tension rollers 92, 93 and 94 as a toner carrier. The image transfer unit 90 further includes a belt cleaning device 32 that faces the first tension roller 92 via the intermediate transfer belt 91. The belt cleaning device 32 is configured to remove residual toner remaining on the intermediate transfer belt 91 that has passed through a secondary transfer nip portion described later.

In the image transfer unit 90, the intermediate transfer belt 91 is endlessly moved in a clockwise direction indicated by an arrow A in FIG. 3 while the intermediate transfer belt 91 is brought into contact with the photoreceptor drums 4K, 4Y, 4M and 4C. The image transfer unit 90 further includes four primary transfer rollers 95K, 95Y, 95M and 95C arranged within a belt loop such that the four primary transfer rollers 95K, 95Y, 95M and 95C come in contact with the respective photoreceptor drums 4K, 4Y, 4M and 4C via the intermediate transfer belt 91. The four primary transfer rollers 95K, 95Y, 95M and 95C arranged within the belt loop press the intermediate transfer belt 91 toward the photoreceptor drums 4K, 4Y, 4M and 4C to form primary transfer nip portions where the intermediate transfer belt 91 comes in contact with the photoreceptor drums 4K, 4Y, 4M and 4C.

The four primary transfer rollers 95K, 95Y, 95M and 95C are charged with a primary image transfer bias by a not shown power source. Thus, by the application of the primary image transfer bias, primary image transfer fields are formed in the primary transfer nip portions to electro-statically transfer the four color K, Y, M, and C toner images from the photoreceptor drums 4K, 4Y, 4M and 4C to the intermediate transfer belt 91. While the intermediate transfer belt 91 endlessly travels in the clockwise direction in FIGS. 2 and 3, the four color K, Y, M and C toner images are sequentially superimposed on the surface of the intermediate transfer belt 91 that has passed through the K, Y, M and C primary transfer nip portions. As a result, a toner image (hereinafter called "four color toner image") is formed on the surface of the intermediate transfer belt 91 based on the primary transfer of the four color superimposed toner images.

Note that the copier 100 employs a primary transfer device configured to include the primary transfer rollers 95 as a primary transfer member; however, the copier 100 may alternatively employ a conductive brush or non-contact corona charger as the primary transfer member.

Referring back to FIG. 4, residual transfer toner, which has not been transferred onto the intermediate transfer belt 91 at the primary transfer nip portions, remains attached on the surfaces of the photoreceptor drums 4 after the photoreceptor drums 4 have passed through the respective primary transfer nip portions. The residual transfer toner is removed from the surfaces of the photoreceptor drums 4 by the respective belt cleaning devices 15 of the image forming unit 3.

The photoreceptor cleaning device 15 includes a photoreceptor cleaning blade 16 made of polyurethane rubber that is in contact with the photoreceptor drum 4 to remove residual transfer toner from the surface of the photoreceptor drum 4 that has passed through the primary transfer nip portion. The photoreceptor cleaning blade 16 is hot-melt bonded with a metallic supporting member fixed on the casing of the image forming unit 3 such that the photoreceptor cleaning blade 16 comes in contact with the photoreceptor drum 4 in a counter direction. Note that the counter direction indicates a direction of the photoreceptor cleaning blade 16 where a front end of the photoreceptor cleaning, blade 16 is located at an upstream side relative to its rear end (free end) in a surface traveling direction of the photoreceptor drum 4.

Note that the toner collected by the photoreceptor cleaning device 15 is collected by a not-shown collecting screw or a not-shown toner recycling device, and the collected toner is further collected by the developing device 6, where the collected toner is reused in a next development.

The static eliminator device arranged in the image forming unit 3 of the copier includes the static eliminator lamp 22, which applies light to the surface of the photoreceptor drum 4 to initialize its surface potential. The surface of the photoreceptor drum 4 neutralized by the static eliminator lamp 22 is uniformly charged by the charging roller 5 configured to generate electric discharge between the charging roller 5 and the photoreceptor drum 4 by electrostatic bias application. The optical writing device 2 (see FIG. 2) then carries out optical writing processing on the uniformly charged surface of the photoreceptor drum 4. Note that the charging device arranged in the image forming unit 3 of the copier 100 is a contact-charger type charging device that employs the charging roller 5. The charging device brings the charging roller 5 into contact with the surface of the photoreceptor drum 4 to apply voltage to the charging roller 5, thereby uniformly charging the surface of the photoreceptor drum 4. Note that the charging device to uniformly charge the photoreceptor drum 4 may be a noncontact-type charging device that employs a noncontact scorotron charger instead of the charging roller 5.

As illustrated in FIG. 3, the sheet transfer unit 28 is provided as a secondary transfer unit beneath the image transfer unit 90 of the printer section 1. The sheet transfer unit 28 includes an endless sheet transfer belt 29 looped over a driving roller 30 and a secondary image transfer roller 31, and is configured to endlessly move the endless sheet transfer belt 29 looped over the driving roller 30 and the secondary image transfer roller 31. In the copier 100, the intermediate transfer belt 91 and the sheet transfer belt 29 are sandwiched between the secondary image transfer roller 31 of the sheet transfer unit 28 and the tension roller 94 of the image transfer unit 90. With this configuration, the secondary transfer nip portion is formed by bringing the surface of the intermediate transfer belt 91 into contact with a surface of the sheet transfer belt 29. The secondary image transfer roller 31 is charged with a secondary image transfer bias by a not-shown power source. The tension roller 94 of the image transfer unit 90 is grounded. Thus, secondary image transfer fields are formed in the secondary image transfer nip portion.

The resist roller pair 33 is provided on the right side of the secondary image transfer nip portion. The resist roller pair 33 rollers transfers the transfer sheet P sandwiched between the resist roller pair 33 to the secondary image transfer nip portion in synchronization with the transfer of the four color toner image on the intermediate transfer belt 91. In the secondary image transfer nip portion, the four color toner image on the surface of the intermediate transfer belt 91 is secondary transferred to the white color transfer sheet P by the secondary image transfer field and nip pressure. As a result, a full-color image is formed in combination with the white color of the transfer sheet P. Having passed through the secondary image transfer nip portion, the transfer sheet P on the surface of which the full-color image is formed is detached from the intermediate transfer belt 91 and while being supported on the surface of the sheet transfer belt 29 is transferred to the fixing device 60 by endless traveling of the sheet transfer belt 29.

Residual transfer toner that has not been transferred onto the transfer sheet P at the secondary image transfer nip portion remains attached to the surface of the intermediate transfer belt 91 that has passed through the secondary image transfer nip portion. The residual transfer toner is scraped and removed by the belt cleaning device 32 configured to be brought into contact with the intermediate transfer belt 91.

After the transfer sheet P is transferred to the fixing device 60 described later, a fixer is applied to the surface of the transfer sheet P in the fixing device 60 to fix the full-color image on the transfer sheet P on which the full-color image is formed; the transfer sheet P is then output from the fixing device 60.

As illustrated in FIG. 2, beneath the sheet transfer unit 28 and the fixing device 60, a switchback device 36 is provided as a transfer sheet reversing device. If images are to be formed on both surfaces of the transfer sheet P, a traveling path of the transfer sheet P that has an image already fixed on a side is switched by a switching claw toward the switchback device 36 so that the transfer sheet P is reentered into the secondary image transfer nip portion. When the transfer sheet P is reentered into the secondary image transfer nip portion, the other side of the transfer sheet P is treated with the secondary image transfer processing and fixing processing to fix the image, and the transfer sheet P having the images fixed on both surfaces is then discharged onto a discharge tray 10.

First Embodiment

Figure 1:
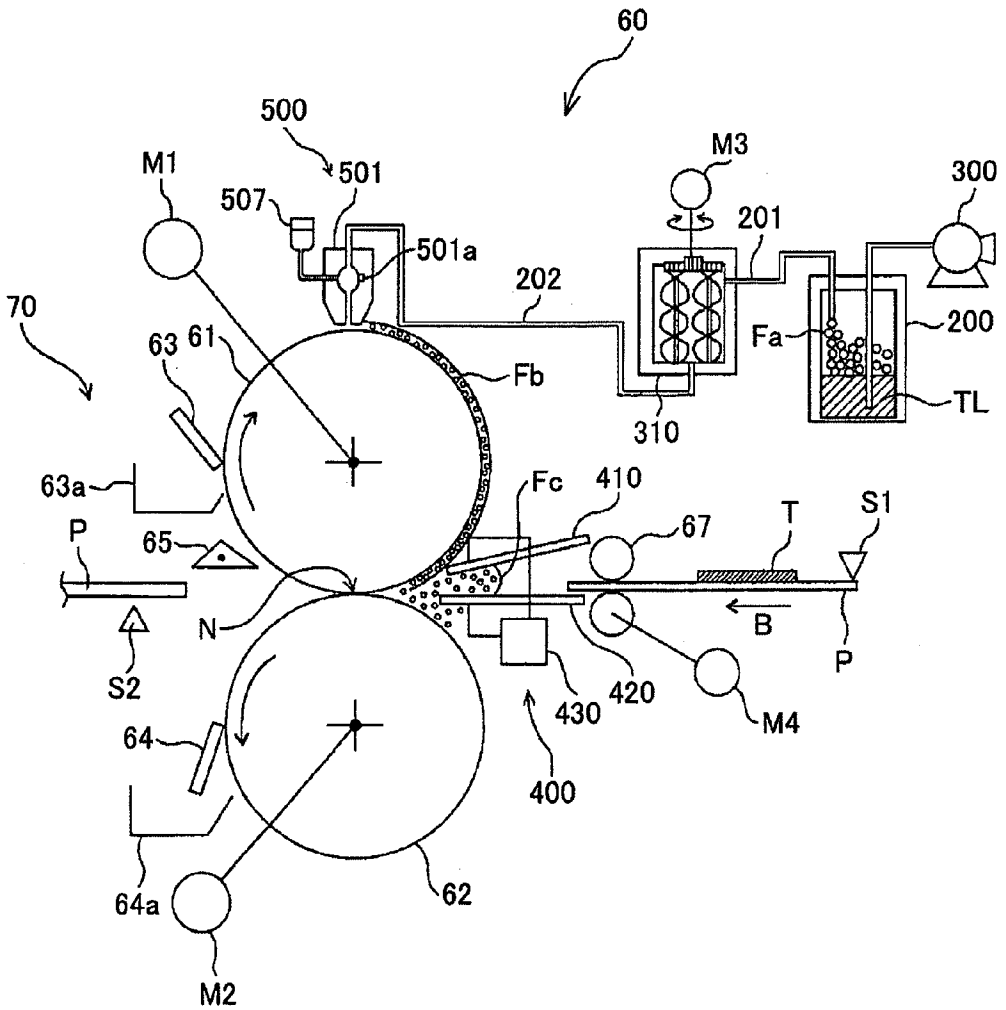
FIG. 1 is a schematic diagram illustrating a fixing device according to a first embodiment.

Next, a first embodiment of the fixing device 60 that may be applied to the copier 100 is described with the accompanying drawings. FIG. 1 is a schematic diagram illustrating the fixing device 60 according to the first embodiment. Hereinafter, a fixer containing no air bubbles is called a "liquid fixer TL", and a fixer containing air bubbles and forming foam is called a "foam fixer F" for convenience. Further, the foam fixer obtained by adding air bubbles to the liquid fixer and having a bubble diameter larger than a predetermined bubble diameter is called an "initial foam fixer Fa", and the foam fixer obtained by allowing the initial foam fixer to be divided and have the predetermined bubble diameter is called a "microbubble foam fixer Fb".

The fixing device 60 according to the first embodiment includes a foam fixer generator section 500 configured to generate the foam fixer F from the liquid fixer TL and a foam fixer application section 70 configured to apply the foam fixer F generated by the foam fixer generator section 500 to the transfer sheet P that carries an unfixed image composed of an unfixed toner layer T.

The foam fixer generator section 500 includes a fixer bottle 200 configured to store the liquid fixer TL and an air pump 300 configured to generate the initial foam fixer Fa composed of rough foam by inject air into the fixer bottle 200 to generate rough foam of the liquid fixer TL. The foam fixer generator section 500 further includes a foam stirrer 310 configured to apply shear force to the initial foam fixer Fa having a large-bubble foam, thereby forming the micro-bubble foam fixer Fb. The foam fixer generator section 500 still further includes a die-coater head 501 configured to uniformly apply the micro-bubble foam fixer Fb formed of the foam fixer F in a thin-film form on a surface of an application roller 61 of the foam fixer application section 70.

Two spiral vanes are arranged in parallel and mutually close to each other inside the foam stirrer 310. The two spiral vanes are connected to a foam stirrer motor M3 as a drive source via gears transmitting the drive force to the two spiral vanes, so that the two spiral vanes are rotated by driving the foam stirrer motor M3. The initial foam fixer Fa composed of rough foam formed inside the fixer bottle 200 passes through gaps between the two rotating spiral vanes, and has a shear force applied while being stirred. Thus, large bubbles of the initial foam fixer are made into smaller bubbles to form the micro-bubble foam fixer Fb.

Figure 5A:
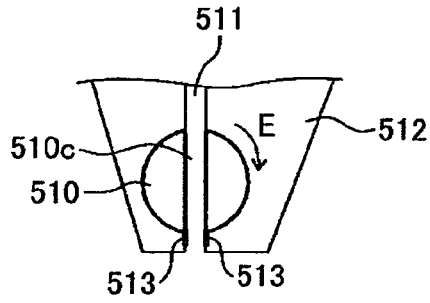
FIG. 5A is an enlarged diagram illustrating a front end of a die-coater head.
Figure 5B:
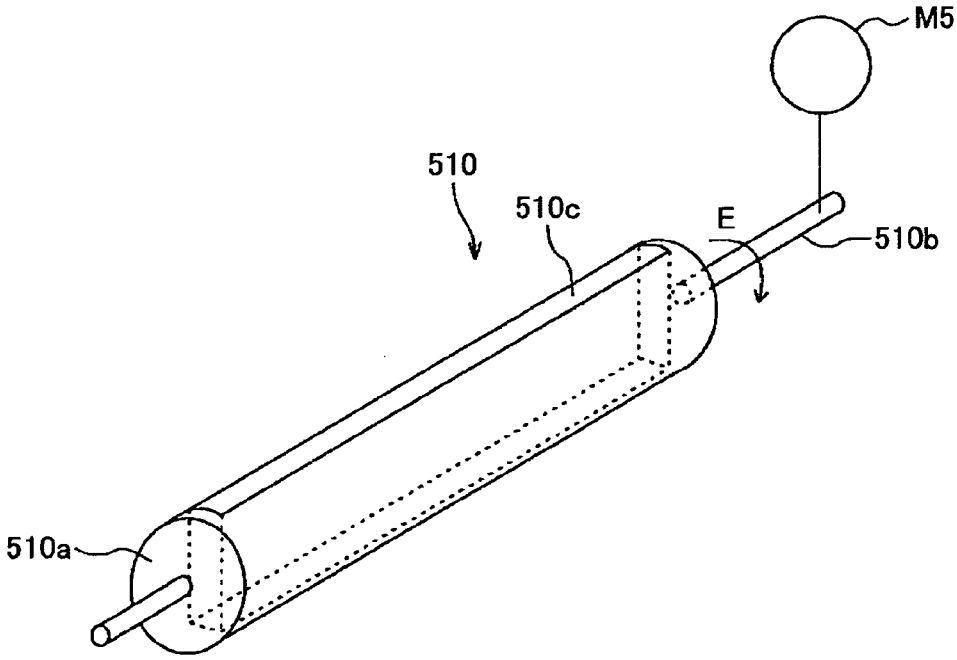
FIG. 5B is a diagram illustrating a front end shutter of the die-coater head.

FIGS. 5A and B are diagrams illustrating a front end of the die-coater head 501. FIG. 5A is an enlarged diagram illustrating the front end of the die-coater head 501, and FIG. 5B is a diagram illustrating a front end shutter 510 of the die-coater head 501. Referring back to FIG. 1, an air introducing valve 507 is connected to a passage of the micro-bubble foam fixer Fb inside the die-coater head 501. As illustrated in FIGS. 5A and 5B, the die-coater head front end shutter 510 is arranged at the front end of the die-coater head 501.

As illustrated in FIG. 5B, the die-coater head front end shutter 510 includes a cylindrical shutter portion 510*a* and a shutter rotational shaft 510*b*, and a shutter aperture 510*c* is formed such that the shutter aperture 510*c* penetrates a sidewall of the cylindrical shutter portion 510*a* in a diameter direction. The shutter rotational shaft 510*b* is connected to a shutter rotating motor M5 as a driving source, such that the cylindrical shutter portion 510*a* is rotated in a direction indicated by an arrow E in FIG. 5 by transmitting a drive force from the shutter rotating motor M5. As illustrated in FIG. 5A, in the die-coater head 501, an head internal passage 511 along which the micro-bubble foam fixer Fb passes is formed inside the die-coater casing 512. If the sidewall of the shutter portion 510*a* excluding an area where the shutter aperture 510*c* is formed faces the internal passage 511, the head internal passage 511 is shielded (enclosed). Thus, the micro-bubble foam fixer Fb is not supplied to the surface of the application roller 61. By contrast, if the shutter portion 510*a* is rotated by driving the shutter rotating motor M5 so that the shutter aperture 510*c* faces the internal passage 511, the head internal passage 511 is in communication with the outside, so that the micro-bubble foam fixer Fb is supplied to the surface of the application roller 61. That is, opening and closing of the die-coater shutter 510 may be controlled by adjusting the transmission of the drive force from the shutter rotating motor M5. The die-coater head 501 further includes a head sealing member 513 configured to prevent the air and the fixer from leaking from a gap between the die-coater head casing 512 and the shutter portion 510*a*.

In the first embodiment, a configuration including the cylindrical shutter portion 510*a* and the shutter rotating motor M5 is described as a shutter mechanism located at the front end of the die-coater head 510 to open and close the communication passage that communicates between inside and outside of the die-coater head 501. However, the configuration of the shutter mechanism at the front end of the die-coater head 510 is not limited to such a configuration. The shutter mechanism may have any configuration insofar as it may open and close the communication passage located at the front end of the die-coater head 501 at predetermined timing. For example, the shutter mechanism may include a movable shutter member to close and open the communication passage and a shutter spring to apply bias to the shutter member to close the communication passage, and a solenoid to control the movement of the shutter member. With this configuration, when the solenoid is turned off, the shutter member closes the communication passage by the bias of the spring member. When the solenoid is turned on, the shutter member opens the communication passage by moving the shutter member in a direction opposite to the bias force of the spring member.

When the fixing device 60 is activated, the foam fixer is discharged from the die-coater head 501, and hence the pressure inside the die-coater head 501 and the passage of the fixer are both higher than the ambient pressure. Thus, even when the air pump 300 and the foam stirrer 310 are deactivated, the pressure inside the die-coater head 501 and the passage remains high. That is, the fixer may leak from the small gap between couplers of the members forming the passage of the fixer or the small gap formed at the front end of the die-coater 501. Accordingly, in the fixing device 60 according to the first embodiment, the air introducing valve 507 is released (open) when the fixing device 60 is deactivated to maintain the pressure inside the die-coater head 501 and the passage of the fixer and the ambient pressure at the same level. Further, the die-coater head front end shutter 510 is configured to close the head internal passage 511 in order to prevent the fixer from leaking from the gaps when the fixing device 60 is deactivated. Moreover, the die-coater head 501 may function as a foam film forming unit to supply the micro-bubble foam fixer Fb on the surface of the application roller 61 in the thin film form.

The foam fixer application section 70 used as a fixer application unit includes the application roller 61 configured to apply the foam fixer Fb generated by the foam fixer generator section 500 over the unfixed toner layer T formed on the transfer sheet P and a pressure roller 62 configured to come in contact with the application roller 61 to form an application nip N. The pressure roller 62 is formed of a sponge roller having a surface elastically deformable surface, and is configured to apply pressure to allow the foam fixer F to penetrate the unfixed toner layer T.

The foam fixer application section 70 further includes an application roller cleaning blade 63 configured to collect a residue such as a residual foam fixer remaining on the surface of the pressure roller 62 that has passed through the application nip N. The foam fixer application section 70 further includes an application roller cleaning blade 64 configured to collect a residue such as a residual foam fixer remaining on the surface of the application roller 61 that has passed through the application nip N. The residue collected by the application roller cleaning blade 63 is stored in an application roller foam collecting tank 63*a*, and the residue collected by the application roller cleaning blade 64 is stored in a pressure roller foam collecting tank 64*a*.

The foam fixer application section 70 further includes a separation claw 65 for separating the transfer sheet P from the application roller 61. The separation claw 65 is provided at a downstream side of the application nip N where the application roller 61 applies the micro-bubble foam fixer Fb on the transfer sheet P in the transfer sheet P transferring direction (i.e., a direction indicated by an arrow B in FIG. 1). The foam fixer application section 70 further includes a sheet front end sensor S1 provided as a sheet front end detector unit configured to detect an end of the transfer sheet P carrying the toner layer T formed of the unfixed toner image. The sheet front end sensor S1 is provided at an upstream side of the application nip N in the transfer sheet P transferring direction. The foam fixer application section 70 further includes a fixing sheet roller pair 67 between the sheet front end sensor S1 and the application nip N, and a fixing sheet transferring motor M4 is connected to the fixing sheet roller pair 67 as a driving source. The upper roller of the fixing sheet roller pair 67 is configured such that the upper roller is brought into contact with margins provided at the sides (i.e., both edges) of the transfer sheet P in a width direction (i.e., a direction perpendicular to the sheet transferring direction). With this configuration, the unfixed toner image formed on the transfer sheet P may not be degraded.

The fixing device 60 includes an application roller driving motor M1 as a driving source of the application roller 61, and a pressure roller driving motor M2 as a driving source of the pressure roller 62. The fixing device 60 further includes a control circuit configured to control components described below.

In the fixing device 60, if the foam fixer Fb is applied on the transfer sheet P at the application nip N formed between the application roller 61 and the pressure roller 62, the foam fixer Fb may be blocked by the application nip N and the foam fixer is accumulated around the nip N, thereby forming foam accumulation Fc as illustrated in FIG. 1. When the transfer sheet P carrying the unfixed toner image is passed through the application nip N with the foam accumulation Fc being still around the nip portion N, part of the surface of the toner layer T that forms the toner image may be removed by the foam accumulation Fc, which may result in a toner offset of the toner image.

Further, since the micro-bubble foam fixer Fb applied on the surface of the application roller 61 by the die-coater head 501 used as the foam film forming unit becomes in a thin layer form, the amount of the micro-bubble foam fixer Fb carried on the surface of the application roller 61 is adjusted such that a small amount of the fixer is applied to the toner layer T while preventing the toner offset. However, if the foam fixer accumulation Fc is formed around an entrance side of the application nip N, too much of the foam fixer F may be applied to the transfer sheet P, thereby degrading image quality such as image deletion due to applying too much of the foam fixer F.

Further, if the foam accumulation Fc is increased around the entrance side of the application nip N, the foam accumulation Fc may prevent the transfer sheet P from being inserted (transferred) into the application nip N, which may cause transfer sheet jamming. The transfer sheet jamming due to the foam accumulation Fc may be significant if a recording medium having low resilience such as thin paper is transferred as the transfer sheet P.

In order to reduce the defects due to the foam accumulation Fc formed at the entrance side of the application nip N, the fixing device 60 according to the first embodiment includes a contact-type foam accumulation sensor 400 and the foam accumulation is removed based on a detected result obtained by the contact-type foam accumulation sensor 400.

Figure 6:
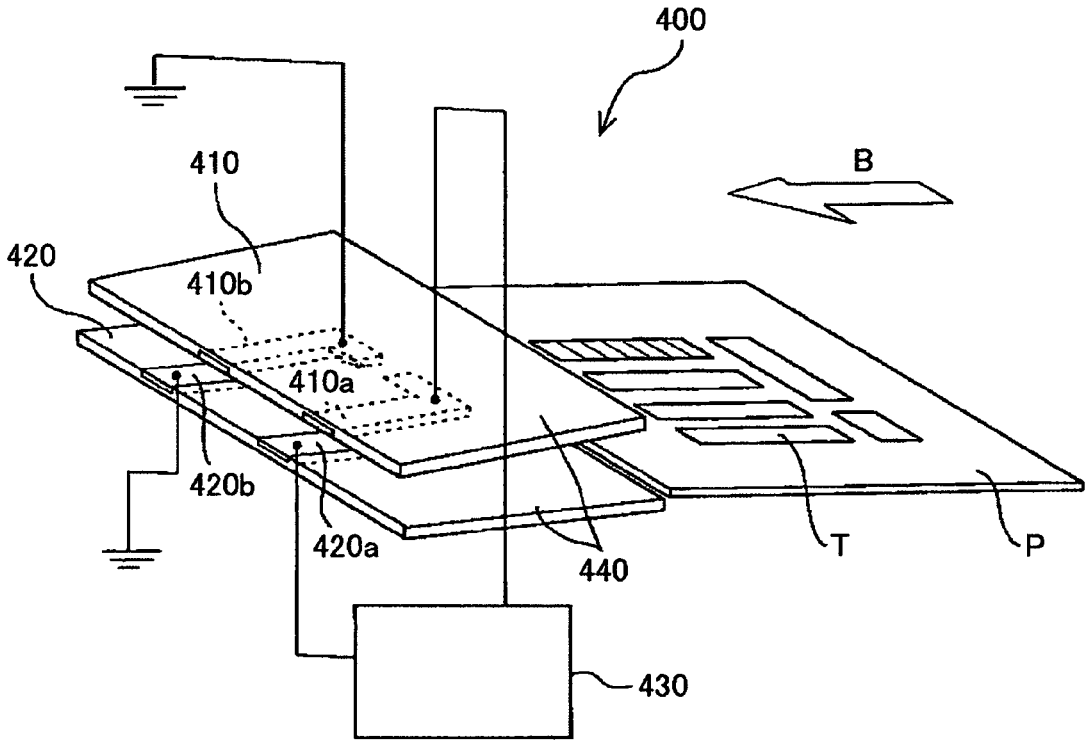
FIG. 6 is a diagram illustrating a contact-type foam accumulation sensor.

FIG. 6 is a diagram illustrating the contact-type foam accumulation sensor 400. In the contact-type foam accumulation sensor 400 illustrated in FIGS. 1 and 6, sensors are formed by embedding an electrode member for detecting the foam accumulation in an insulator member. The contact-type foam accumulation sensor 400 includes an upper guide plate 410 and a lower guide plate 420 arranged such that the upper guide plate 410 and the lower guide plate 420 mutually face each other via a region where the transfer sheet P is passed through. The upper guide plate 410 is formed by embedding two electrode members, namely, a first upper electrode 410*a* and a second upper electrode 410*b* in an insulator member 440 made of resin or ceramics. The lower guide plate 420 is formed by embedding two electrode members, namely, a first lower electrode 420*a* and a second lower electrode 420*b* in an insulator member 440.

As illustrated in FIG. 6, the second upper electrode 410*b* and the second lower electrode 420*b* are grounded, and the first upper electrode 410*a* and the first lower electrode 420*a* are connected to a current detector 430.

The current detector 430 includes a not-shown voltage applying unit configured to apply a predetermined voltage to the first upper electrode 410*a* and the first lower electrode 420*a*. When the first upper electrode 410*a* and the first lower electrode 420*a* are not in electrical conduction with the respective second upper electrode 410*b* and second lower electrode 420*b*, the electric potentials of the first upper electrode 410*a* and the first lower electrode 420*a* are raised, thereby causing the current detector 430 to generate a high-level (H-level) signal. When the first upper electrode 410*a* and the first lower electrode 420*a* are in electrical conduction with the respective second upper electrode 410*b* and second lower electrode 420*b*, the first upper electrode 410*a* and the first lower electrode 420*a* are grounded, and the electric potentials of the first upper electrode 410*a* and the first lower electrode 420 are lowered, thereby causing the current detector 430 to generate a low-level (L-level) signal.

In this embodiment, conductive liquid is used as the fixer. Thus, when the foam accumulation Fc comes into contact with the electrodes of the current detector 430 such that the first upper electrode 410*a* is in conduction with the second upper electrode 410*b*, and similarly the first lower electrode 420*a* is in conduction with the second lower electrode 420*b*, the current detector 430 generates an L-level signal. With such a configuration, if the foam accumulation Fc is increased such that the upper electrode members or lower electrode members are in conduction, the current detector 430 generates an L-level signal which a later described fixing device CPU 700 (see FIG. 7) detects as "foam accumulation". If the foam accumulation Fc is not formed, or is not increased to the extent that the upper electrode members or lower electrode members are in conduction, the current detector 430 generates an H-level signal which the fixing device CPU 700 detects as "No foam accumulation".

In the fixing device 60 according to the first embodiment, when the fixing device CPU 700 detects the "foam accumulation" state, the application of the micro-bubble foam fixer Fb on the application roller 61 is stopped while the application roller 61 and the pressure roller 52 are rotated as a foam accumulation removal operation. With this operation, the foam accumulation Fc may gradually be moved toward an exit side of the application nip N.

Figure 7:
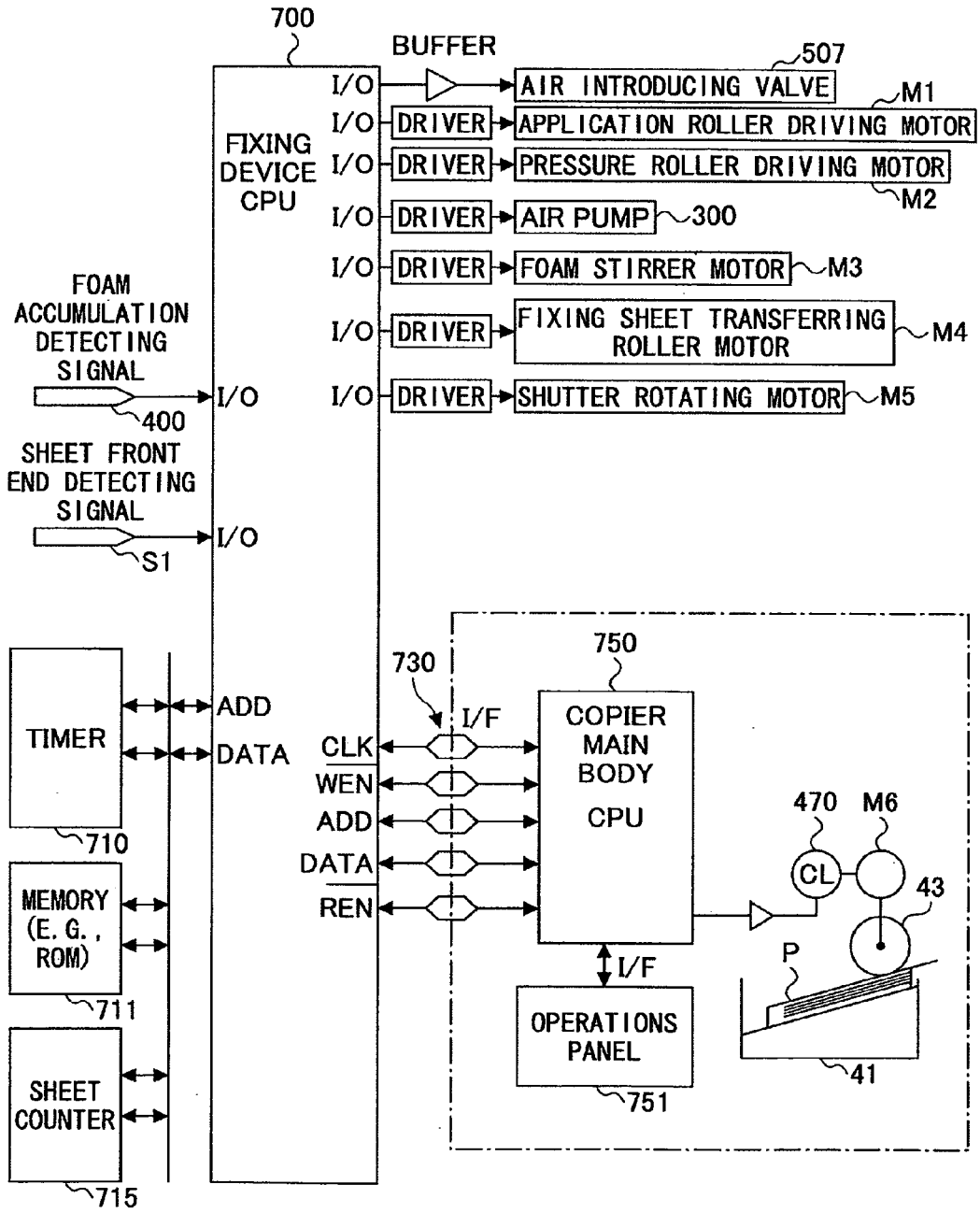
FIG. 7 is a block diagram illustrating a control circuit provided in the fixing device according to the first embodiment.

Next, a sequence of the fixing operation of the fixing device 60 is described with reference to a block diagram of a control circuit. FIG. 7 is a block diagram illustrating the control circuit provided in the fixing device 60 according to the first embodiment. As illustrated in FIG. 7, the control circuit of the fixing device 60 includes the fixing device CPU 700 having an A/D, D/A terminals, storage units such as a ROM and a RAM, and externally provided timer 710, memory 711, and counter 715. The fixing device CPU 700 controls the rollers, the driving motors M1 to M5 of the foam stirrer 310, the air pump 300 connected to the fixer bottle 200, and the like based on the signals supplied from the sensors (e.g., S1 and 400). The fixing device CPU 700 provided inside the fixing device 60 and a copier main body CPU 750 provided in a main body of the copier 100 are connected via an interface IF communication connection section 730 where command and status information are transmitted and received for the communications between the fixing device CPU 700 and the copier main body CPU 750. The fixing device CPU 700 is supplied with a power ON/OFF signal of the copier 100 main body, a print start signal, and an emergency stop signal from an interrupt terminal via the IF communication connection section 730.

When the power of the copier 100 is turned ON, the fixing device CPU 700 switches ON the air introducing valve 507 (i.e., closes the air introducing valve), so that the head internal passage 511 of the die-coater head 501 is closed (shut). A configuration to close the head internal passage 511 is as follows. A rotational position of the cylindrical shutter portion 510*a* is detected by a not-shown position sensor. If the shutter aperture 510*c* of the shutter portion 510*a* is located at a position that faces the head internal passage 511, the fixing device CPU 700 drives the shutter rotating motor M5 such that the sidewall of the shutter portion 510*a* rotates to a position that faces the head internal passage 511 and stops at that position.

Subsequently, the fixing device CPU 700 switches ON the air pump 300 and the foam stirrer motor M3. When the fixing device CPU 700 switches ON the air pump 300, air is introduced into the fixer bottle 200 and the liquid fixer TL is mixed with the introduced air, thereby initiating forming of the initial foam fixer Fa composed of rough foam inside the fixer bottle 200. The initial foam fixer Fa formed inside the fixer bottle 200 is transferred by the pressure of the air pump 300 to the foam stirrer 310 driven by the foam stirrer motor M3. The initial foam fixer Fads transferred to the foam stirrer 310 where the initial foam fixer Fa has a shear force applied to split the initial foam fixer Fa into smaller bubbles by the two spiral vanes while being rotated by driving of the foam stirrer motor M3, thereby forming the micro-bubble foam fixer Fb composed of dense foam. The micro-bubble foam fixer Fb formed by the foam stirrer 310 is subsequently transferred to the die-coater head 501.

The micro-bubble foam fixer Fb transferred to the die-coater head 501 is spread in a crosswise direction (i.e., an image width direction) in a manifold 501*a*. The manifold 501*a* is soon filled with the micro-bubble foam fixer Fb.

Thereafter, when the print start signal is transmitted from the copier CPU 750 controlling a programmable logic controller of the copier 100 main body to the fixing device CPU 700 via the IF communication connection section 730, the fixing device CPU 700 switches ON the application roller driving motor M1 and the pressure roller driving motor M2. Accordingly the application roller 61 and the pressure roller 62 start rotating.

In the die-coater head 501, the air pump 300 is driven while the head internal passage 511 of the shutter portion 510*a* is closed, thereby increasing the pressure inside the die-coater head 501.

While the head internal passage 511 of the shutter portion 510*a* is closed and the pressure inside the die-coater head 501 is increased, a printing operation is carried out in the copier 100 main body. That is, the toner image formed on the intermediate transfer belt 91 is transferred onto the transfer sheet P at the secondary nip portion, and the transfer sheet P carrying the unfixed toner image is transferred to the fixing device 60 by the sheet transfer unit 28.

The transfer sheet P carrying the unfixed toner image is transferred from the secondary transfer nip portion while the pressure inside the die-coater head 501 is raised; the fixing device CPU 700 causes the sheet front end sensor S1 to detect a front end of the transfer sheet P, and drives the shutter rotating motor M5 to rotate the shutter portion 510*a* of the die-coater head 501 so that the head internal passage 511 of the die-coater head 501 may communicate externally at a timing of applying the foam fixer F. Since the head internal passage 511 is externally communicating, the micro-bubble foam fixer Fb is supplied from the die-coater head 501 to the application roller 61. Along with this foam supply operation, the fixing device CPU 700 sets the application length of the micro-bubble foam fixer Fb in the timer 710 based on information on the linear velocity and the size of the transfer sheet P sent by the copier main body CPU 750.

After setting the application length to the timer 710, the fixing device CPU 700 compares a shutter opening timer setting time stored in advance in a memory 711 of the fixing device CPU 700 determined based on the application length with a count value of an executive timer. The micro-bubble foam fixer Fb is applied from the die-coater head 501 to the application roller 61 until the shutter opening timer setting time matches the count value of the executive timer. Thus, the micro-bubble foam fixer Fb is applied to the unfixed toner image formed on the transfer sheet P while the surface of the application roller 61 carrying the micro-bubble foam fixer Fb and the transfer sheet P carrying the unfixed toner image pass through the application nip N.

After the micro-bubble foam fixer Fb is applied to the transfer sheet P, the pressure roller 62 applies pressure to the micro-bubble foam fixer such that the micro-bubble foam fixer penetrates beneath the toner layer T forming an unfixed toner image and further penetrates the transfer sheet P. As a result, fiber of paper of the transfer sheet P and resin in the toner softened by the fixer are intertwined, thereby completing the fixing of the toner image on the transfer sheet P. In the copier 100, the transfer sheet P now carrying the fixed toner image is discharged via a discharge roller 35 to the discharge tray 10 as a printed output.

While the sequence of the fixing operation described above is carried out, the fixing device CPU 700 regularly checks foam accumulation detecting signals generated from the current detector 430 of the contact-type foam accumulation sensor 400. If the foam accumulation detecting signal is an H-level and the fixing device CPU 700 detects the "no foam accumulation" state, the fixing device CPU 700 continues the above-described fixing operation. If, on the other hand, the foam accumulation detecting signal is an L-level and the fixing device CPU 700 detects the "foam accumulation" state, the fixing device CPU 700 reports the "foam accumulation" state to the copier main body CPU 750 via the IF communication connection section 730.

On receiving the report indicating the "foam accumulation" state, the copier main body CPU 750 turns OFF a sheet transfer clutch 470 connected to a sheet transfer motor M6 that is a driving source of the sheet feeder rollers 43 and the sheet separation rollers 45 arranged for the sheet cassettes 42. Thus, the feeding of the transfer sheet P from the sheet feeder 40 to the printer section 1 is stopped. The printing operation and the fixing operation are repeatedly carried out on the transfer sheets remaining in the sheet transfer path from the sheet feeder path 44 to the fixing device 60 until the image formation and fixation are completed with all the remaining transfer sheets.

When the copier main body CPU 750 receives the foam accumulation report and the copier 100 main body as a print job, the copier main body CPU 750 turns off the sheet transfer clutch 470 and allows the printing operation and fixing operation to carry on executing until the image formation and the image fixation of all the transfer sheets P remaining in the transfer path are completed.

After the completion of the image formation and image fixation, the foam accumulation removal operation is executed. The foam accumulation removal operation involves controlling the shutter rotating motor M5 to close the head internal passage 511 of the die-coater head 501 and driving continuously the application roller driving motor M1 and the pressure roller driving motor M2 until the fixing device CPU 700 detects the "no foam accumulation" state.

The application roller 61 and the pressure roller 62 are rotated by driving the application roller driving motor M1 and the pressure roller driving motor M2 such that the foam accumulation Fc formed of the foam fixer F is gradually transferred toward the exit side of the application nip N. The foam fixer F transferred to the exit side of the application nip N is then collected by the application roller cleaning blade 63 or the pressure roller cleaning blade 64. The foam accumulation Fc formed at the entrance side of the application nip N is removed in this manner.

Note that the rotational speeds of the application roller 61 and the pressure roller 62 may be increased for further accelerating the transfer of the foam accumulation Fc formed of the foam fixer F toward the exit side of the application nip N by the rotation of the application roller 61 and the pressure roller 62 when the foam accumulation removal operation is performed.

The foam fixer collected by the application roller cleaning blade 63 or the pressure roller cleaning blade 64 is stored in the corresponding application roller foam collecting tank 63*a* or the pressure roller foam collecting tank 64*b*, and the collected fixer in the collecting tank 63*a* or 64*b* is manually disposed by an operator. Note that if the fixing device 60 employs a recycling configuration, the collected fixer may be returned to the foam fixer generator section via the recycling system.

When the foam accumulation removal operation is performed and the fixing device CPU 700 detects the "no foam, accumulation" state, the fixing device CPU 700 reports the "no foam accumulation" state to the copier main body CPU 750 via the IF communication connection section 730. On receiving the report indicating the "no foam accumulation" state, the copier main body CPU 750 turns ON the sheet transfer clutch 470 to restart the normal printing operation.

In the copier 100 main body, since the feeding of the transfer sheet P is suspended while the foam accumulation removal operation is being performed, the operator may misconceive the transfer sheet P feeding suspension as the malfunction of the copier 100. In order to prevent the operator from misconceiving the transfer sheet P feeding suspension as the malfunction of the copier 100, the copier main body CPU 750 explicitly reports to the operator via displaying a message on an operations panel 751 or the monitor of the personal computer (PC) that the foam accumulation removal operation is currently being conducted in the copier 100 main body while the foam accumulation removal operation is being performed. The display content of the foam accumulation removal operation may not be specific as stating that "the foam accumulation removal operation is currently being performed", but simply be as that "maintenance is currently being performed".

If the foam accumulation signal is not detected at the time the print jobs are completed, the fixing device CPU 700 determines that the copier 100 is in a normal operation. The fixing device CPU 700 then drives the application roller driving motor M1 and the pressure roller driving motor M2 to rotate the application roller 61 and the pressure roller 62 for the time while all the remaining foam fixer F on the application roller 61 and the pressure roller 62 are collected (by comparing the prescribed value set to the memory 711 and the counted value of the timer 710), and then deactivates the application roller driving motor M1 and the pressure roller driving motor M2 to complete the sequence of the fixing operation.

When deactivating the application roller driving motor M1 and the pressure roller driving motor M2, the fixing device CPU 700 controls the shutter rotating motor M5 such that the air introducing valve 507 is turned off to introduce the ambient atmosphere inside the die-coater head 501, and the shutter portion 510*a* shields (closes) the internal head passage 511 at the end of the die-coater head 501.

Note that the fixing device CPU 700 regularly checks the foam accumulation detecting signal per transfer of the transfer sheet P (i.e., between the transfers of the two transfer sheets P). When the fixing device CPU 700 checks the foam accumulation detecting signal and detects the "foam accumulation" state, the fixing device CPU 700 performs the foam accumulation removal operation at the time the print jobs are completed. However, if there are numerous print jobs, the fixing device CPU 700 may temporarily stop transferring (feeding) the transfer sheet P in the middle of the print jobs, wait for the image formation on the transfer sheet P to finish, and initiate the foam accumulation removal operation. Alternatively, the fixing device CPU 700 may carry out the foam accumulation removal operation while initializing the copier 100 when the power is supplied to the copier 100 or when the print jobs are completed.

If the copier 100 is a low-speed copier or an intermediate-speed copier, the copier 100 may have sufficient time between the transfers of the two transfer sheets P to detect the foam accumulation signal and perform the foam accumulation removal operation; or the copier 100 may have time to detect the foam accumulation signal after a first transfer of the transfer sheet P (between the first and second transfers of the transfer sheet P) and time to perform the foam accumulation removal operation after a second transfer of the transfer sheet P (between the second and third transfers of the transfer sheet P). If the copier 100 determines that the print jobs are not temporarily stopped as in this case, it is preferable to carry out the foam accumulation removal operation during the sequence of the normal printing operations for simplifying the programmable logic controller of the copier 100 main body.

Second Embodiment

Figure 8:
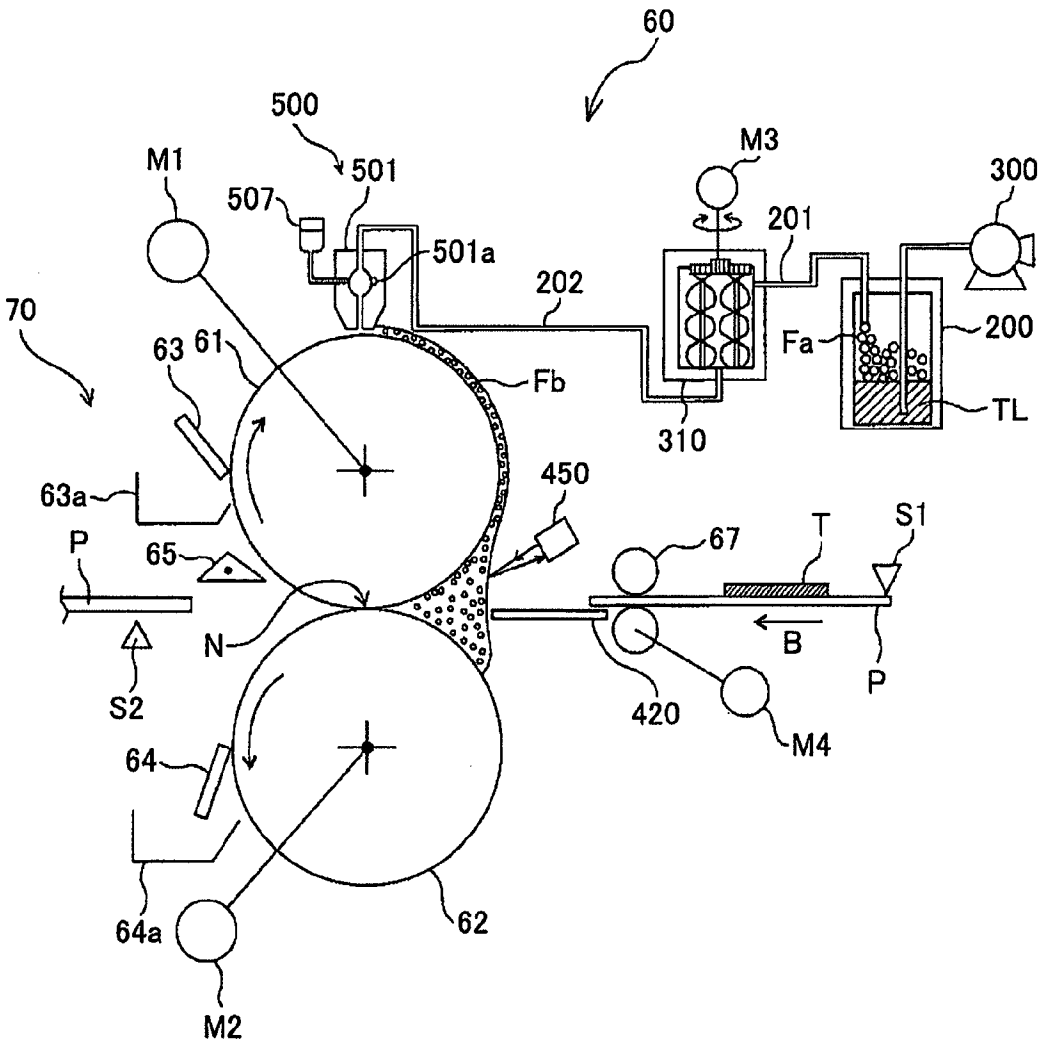
FIG. 8 is a schematic diagram illustrating a fixing device according to a second embodiment.

Next, a second embodiment of a fixing device 60 that may be applied to the copier 100 is described with the accompanying drawings. FIG. 8 is a schematic diagram illustrating the fixing device 60 according to the second embodiment.

The fixing device 60 according to the second embodiment includes an optical foam accumulation sensor 450 having a light-emitting element and a light-receiving element in place of the contact-type foam accumulation sensor 400 provided for the fixing device 60 according to the first embodiment. As illustrated in FIG. 8, the optical foam accumulation sensor 450 is configured to emit light toward the entrance side of the application nip N by the not-shown light-emitting element and receive reflected light reflected from the entrance side of the application nip N by the not-shown light-receiving element such that the foam accumulation Fc accumulated at the entrance side of the application nip N is detected based on a change in the amounts of received light.

The contact-type foam accumulation sensor 400 provided for the fixing device 60 according to the first embodiment includes the two electrode members embedded in each of the upper and lower guide plates 410 and 420 formed of the insulator member 440 made of resin or ceramics, and the foam accumulation Fc is detected based on whether the two electrode members embedded in each of the upper and lower guide plates 410 and 420 are electrically conductive. With this configuration, the two electrode members are electrically conductive when the fixer made of the conductive liquid is brought into contact with the two electrode members, and the foam accumulation Fc is detected based on whether the two electrode members are electrically conductive. Thus, with this configuration, since the fixer is directly in contact with the electrode members, the components contained in the fixer may remain attached on the surfaces of the electrode members. Accordingly, the components attached on the surfaces of the electrode members may form a film to increase resistance values, thereby interfering with the electric conductivity generated between the two electrode members. This may degrade reliability in foam accumulation detection.

Further, with this contact-type foam accumulation sensor, since detective members (i.e., two electrodes in the first embodiment) need to be arranged in positions where they may be brought into contact with the foam fixer F (i.e., the foam accumulation Fc), the layout ranges of the detective members may be restricted.

By contrast, the optical foam accumulation sensor 450 provided for the fixing device 60 according to the second embodiment is a non-contact type foam accumulation sensor to which the components contained in the fixer are not attached. Thus, the reliability in foam accumulation detection may not be degraded.

The fixing device 60 according to the second embodiment includes the reflective optical foam accumulation sensor 450 having the light-emitting element and the light-receiving element as the non-contact type foam accumulation sensor. The non-contact type foam accumulation sensor provided for the fixing device 60 according to the second embodiment may not be limited to the optical foam accumulation sensor 450, and may be other non-contact sensors such as a CCD image sensor.

Next, operations to detect the foam accumulation Fc performed by the optical foam accumulation sensor 450 are described. In the fixing device according to the second embodiment, the surfaces of the application roller 61 and the pressure roller 62 have dark colors that exhibit low reflectance. With this configuration, if there is little foam accumulation Fc at the entrance side of the application nip N, light emitted from the light-emitting element of the optical foam accumulation sensor 450 falls on the surface of the application roller 61 or the pressure roller 62 and is then reflected off the surface. At this moment, since the surfaces of the application roller 61 and the pressure roller 62 have dark colors that exhibit low reflectance, the amount of light reflected back to the light-receiving element is small.

However, if there is the foam accumulation Fc at the entrance side of the application nip N, the foam accumulation Fc interferes with the gap between the light-emitting element and the surfaces of the application roller 61 and the pressure roller 62 and then light reflects off the surface. Thus, the light emitted from the light-emitting element is reflected off the surface of the foam accumulation. Since the foam fixer F has a color close to white, the amount of light reflected back to the light-receiving element is large.

As described above, the amount of light reflected back to the light-receiving element differs between the presence and absence of the foam accumulation Fc, and hence it may be possible to detect the foam accumulation Fc based on the change in the amount of light received by the light-receiving element of the optical foam accumulation sensor 450. In this case, since the optical foam accumulation sensor 450 is capable of detecting the foam accumulation Fc without having contact with the fixer, any drawbacks that may occur due to the components of the fixer becoming attached to a detective sensor may be controlled.

Further, the fixing device 60 according to the second embodiment further includes a pressure roller detaching mechanism to detach the pressure roller 62 from the application roller 61. With this configuration, when the fixing device 60 according to the second embodiment performs the foam accumulation Fc removal operation, the pressure roller detaching mechanism detaches the pressure roller 62 to move it away from the application roller 61.

In the fixing device 60 according to the first embodiment, when the fixing device CPU 700 detects the "foam accumulation" state, the application of the micro-bubble foam fixer Fb on the application roller 61 is stopped while the application roller 61 and the pressure roller 52 are rotated until the fixing device CPU 700 detects the "no foam accumulation" state as the foam accumulation removal operation. In the first embodiment, when the application roller 61 and the pressure roller 62 are rotated while the application roller 61 and the pressure roller 62 are in contact with each other, the amount of the fixer transferred toward the exit side of the application nip N is restricted by the application nip N. In this case, it may take a long time for the fixing device CPU 700 to detect the "no foam accumulation" state if the amount of the foam fixer forming the foam accumulation Fc is large, which may increase time to stop the printing operation of the copier 100.

By contrast, since the fixing device 60 according to the second embodiment includes the pressure roller detaching mechanism to detach the pressure roller 62 away from the application roller 61 while the foam accumulation removal operation is performed, the fixer transferred' toward the exit side of the application nip N may be less restricting, which may decrease the time for the foam accumulation removal operation. Accordingly, with this configuration, the time to stop the printing operation of the copier 100 may be prevented from increasing.

Figure 9:
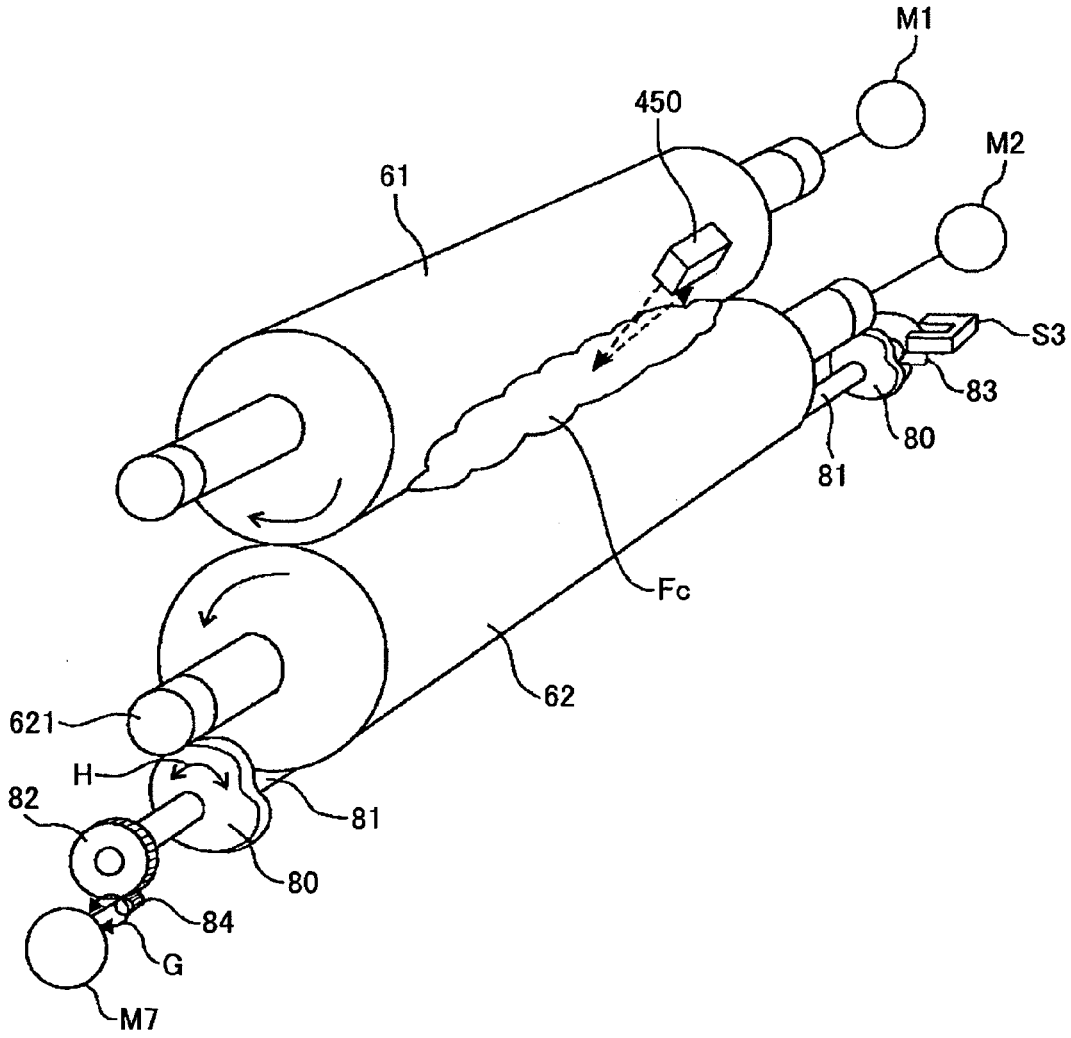
FIG. 9 is a perspective diagram illustrating a pressure roller detaching mechanism.
Figure 10:
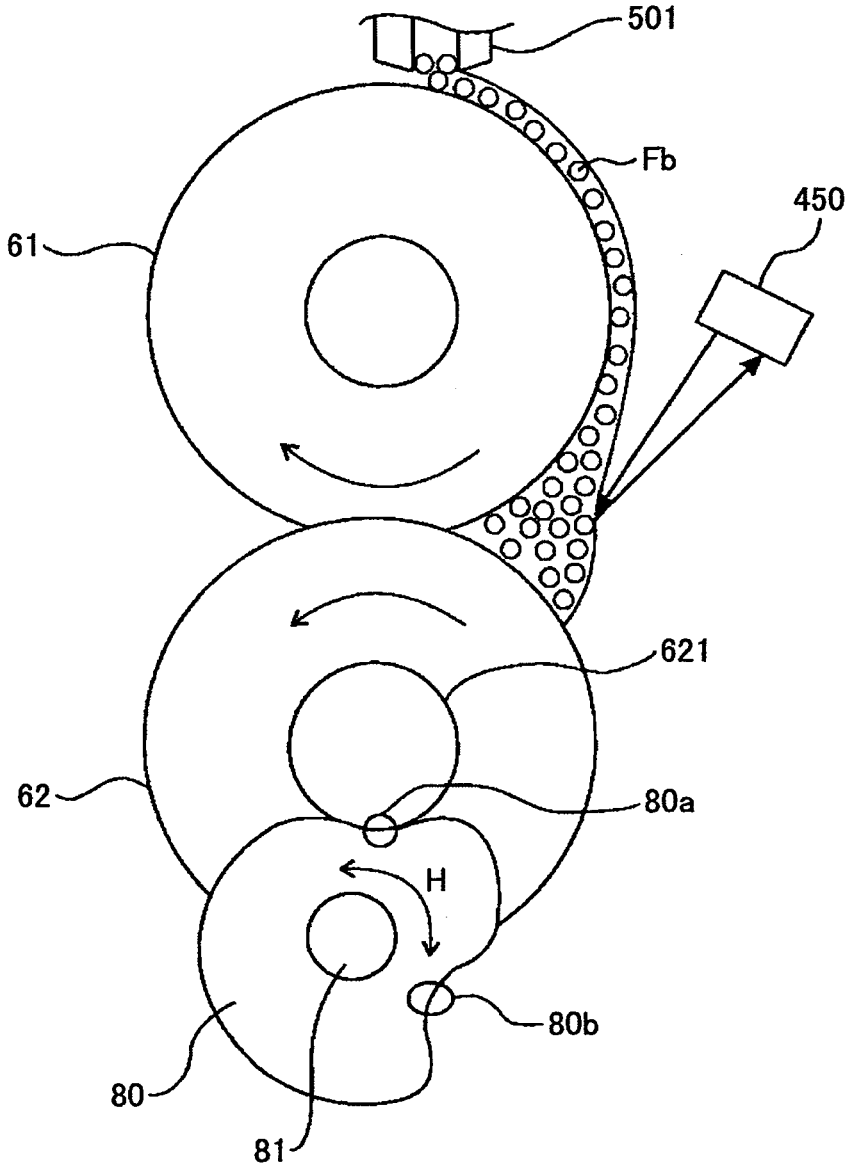
FIG. 10 is a side diagram illustrating the pressure roller detaching mechanism.

FIGS. 9 and 10 are diagrams illustrating the pressure roller detaching mechanism, where FIG. 9 is a perspective view and FIG. 10 is a side view of the pressure roller detaching mechanism. As illustrated in FIGS. 9 and 10, the fixing device 60 according to the second embodiment includes the pressure roller detaching mechanism composed of a pressure roller detaching cam 80, a cam driving motor M7, a motor gear 84, a cam rotating gear 82, and a shaft 81. In the pressure roller detaching mechanism, the fixing device CPU 700 controls the driving of the cam driving motor M7 to rotate the motor gear 84 in a direction indicated by an arrow G in FIG. 9, and the driving of the cam driving motor M7 is then transmitted via the cam rotating gear 82 and the shaft 81 to rotate the pressure roller detaching cam 80 in a direction indicated by an arrow H in FIGS. 9 and 10.

As illustrated in FIG. 10, the pressure roller detaching cam 80 includes two recess portions in a circumference of its disk-shaped member. In the pressure roller detaching cam 80, the two recess portions are located at positions having different distances from the rotational center of the shaft 81, where the recess portion having a distance away from the rotational center is a pressure position 80*a* and the recess portion having a distance near the rotational center is a detaching position 80*b*.

An engaging position where a bearing 621 of the pressure roller 62 engages the pressure roller detaching cam 80 may be changed by rotating the pressure roller detaching cam 80 in the direction indicated by the arrow H in FIG. 10. When the bearing 621 of the pressure roller 62 engages the pressure position 80*a* of the pressure roller detaching cam 80, the pressure roller 62 is brought into contact with the application roller 61, and when the bearing 621 of the pressure roller 62 engages the detaching position 80*b* of the pressure roller detaching cam 80, the pressure roller 62 is moved away from the application roller 61.

Further, the shaft 81 includes a cam position detecting filler 83 fixed on the shaft 81. Accordingly, a position of the cam position detecting filler 83 may change the in a rotational direction based on the rotation of the shaft 81. Thus, the position of the pressure roller detaching cam 80 in the rotational direction may be detected by causing a cam position sensor S3 (see FIG. 9) to detect the position of the cam position detecting filler 83 in the rotational direction.

There is disclosed a related art fixing device with a fixing roller and a pressure roller that includes the pressure roller detaching mechanism configured to release the pressure applied by the pressure roller on the fixing roller. In the related art fixing device having the above configuration, if paper jamming occurs in a fixing nip, the paper jamming is manually fixed by an operator pulling the transfer paper sandwiched between the rollers forming the fixing nip. When the paper jamming is fixed by the operator in the above manner, the rotational drive of the rollers forming the fixing nip will not be carried out for securing the operator's safety.

By contrast, in the fixing device 60 according to the second embodiment, when the fixing device CPU 700 detects the "foam accumulation" state, the pressure roller detaching mechanism releases the pressure applied by the pressure roller 62 on the application roller 61 or detaches the pressure roller 62 from the application roller, and thereafter the application roller 61 and the pressure roller 52 are rotated. Accordingly, the foam accumulation Fc formed of the foam fixer F accumulated neat the entrance side of the application nip N is transferred to the exit side of the application nip N in a short time. The foam fixer F transferred to the exit side of the application nip N is then collected by the application roller cleaning blade 63 or the pressure roller cleaning blade 64. The foam accumulation Fc formed at the entrance side of the application nip N is removed in this manner.

Figure 11:
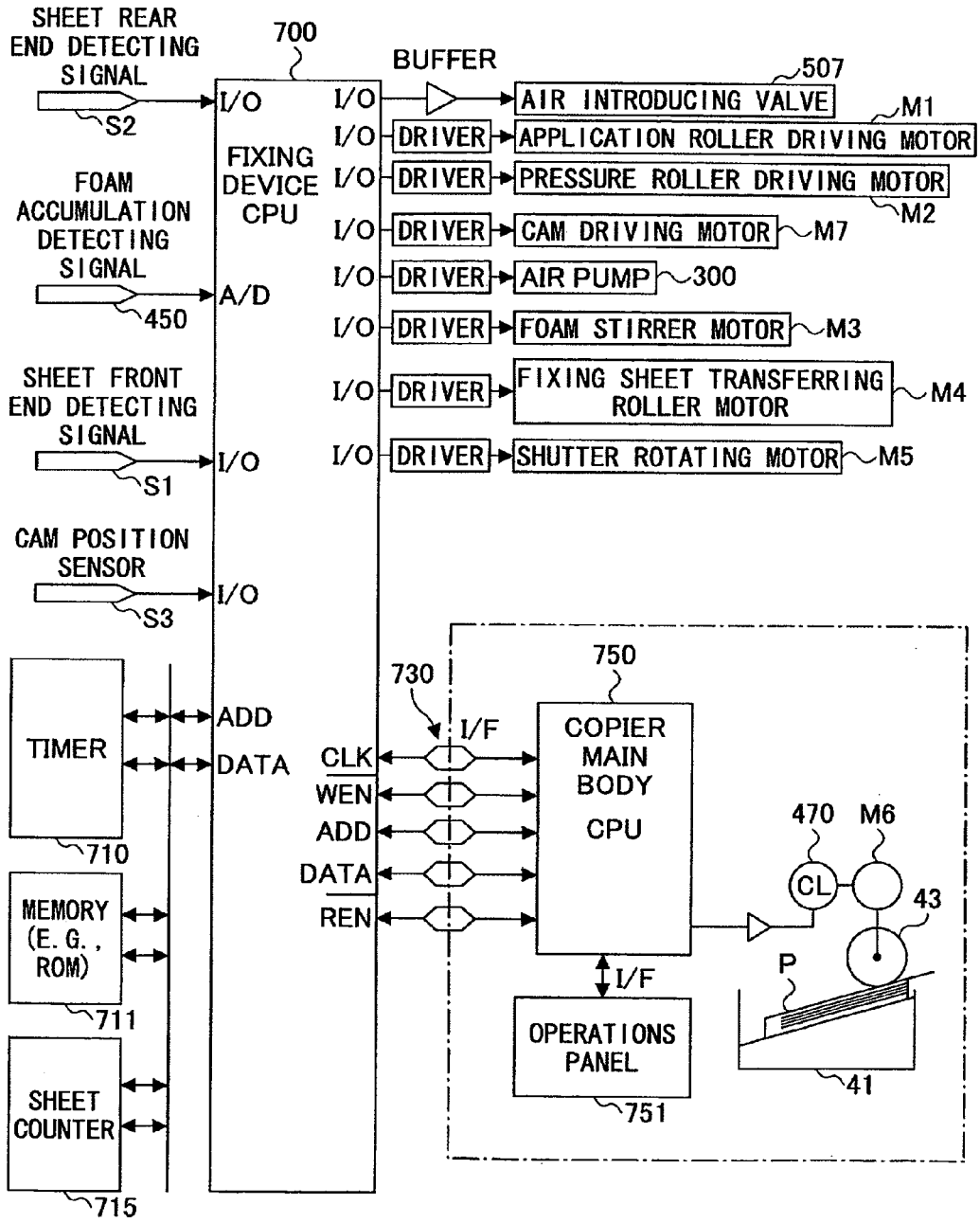
FIG. 11 is a block diagram illustrating a control circuit provided in the fixing device according to the second embodiment.

FIG. 11 is a block diagram illustrating the control circuit provided in the fixing device 60 according to the second embodiment. The fixing device 60 according to the second embodiment has the same configuration as the fixing device 60 according to the first embodiment except that the foam accumulation sensor is a non-contact type and the pressure roller 62 is detached from the application roller 61 while performing the foam accumulation removal operation.

In the normal image forming operation carried out after the copier 100 is turned on, the processes, in which the toner image is formed on the transfer sheet P, and the transfer sheet P carrying the fixed toner image is then discharged via the discharge roller 35 to the discharge tray 10 as a printed output, are similar to those described in the fixing device 60 according to the first embodiment. Accordingly, the descriptions of the processes are thus omitted. While a normal image forming operation is carried out in the copier 100 and the sequence of fixing operation is carried out in the fixing device 60, the fixing device CPU 700 regularly checks foam accumulation detecting signals generated from the optical foam accumulation sensor 450. As described above, the amount of light reflected back to the light-receiving element differs between the presence and absence of the foam accumulation Fc, and hence the amount of light received by the light-receiving element of the optical foam accumulation sensor 450 may be input to an A/D terminal of the fixing device CPU 700 as a foam accumulation detecting signal. The fixing device CPU 700 of the fixing device 60 according to the second embodiment detects the "no foam accumulation" state while the amount of light received by the light-receiving element is equal to or less than a predetermined amount based on the foam accumulation detecting signal input via the A/D terminal, whereas the fixing device CPU 700 detects the "foam accumulation" state when the amount of light received by the light-receiving element is greater than a predetermined amount.

On detecting the "foam accumulation" state, the fixing device CPU 700 reports the "foam accumulation" state to the copier main body CPU 750 via the IF communication connection section 730. On receiving the report indicating the "foam accumulation" state, the copier main body CPU 750 turns OFF the sheet transfer clutch 470 connected to the sheet transfer motor M6 that is a driving source of the sheet feeder rollers 43 and the sheet separation rollers 45 arranged for the sheet cassettes 42. Thus, the feeding of the transfer sheet P from the sheet feeder 40 to the printer section 1 is stopped. The printing operation and the fixing operation are repeatedly carried out on the transfer sheets remaining in the sheet transfer path from the sheet feeder path 44 to the fixing device 60 until the image formation and fixation are completed with all the remaining transfer sheets.

On detecting the "foam accumulation" state, the fixing device CPU 700 transmits an activation signal to the cam driving motor M7 to activate the driving of the cam driving motor M7. In this process, a change in the position of the pressure roller detaching cam 80 in the rotational direction may be detected by causing the cam position sensor S3 (see FIG. 9) to detect the position of the cam position detecting filler 83 in the rotational direction. Accordingly, the fixing device CPU 700 may drive the cam driving motor M7 until the bearing 621 of the pressure roller 62 engages the detaching position 80*b* of the pressure roller detaching cam 80 while monitoring the change in the position of the pressure roller detaching cam 80. Thus, the pressure applied by the pressure roller 62 to the application roller 61 is released and the foam fixer F forming the foam accumulation Fc may be easily passed through the application nip N toward the exit of the application nip N.

With this configuration, after the pressure applied on the application roller 61 is released, the fixing device CPU 700 transfers the foam fixer F forming the foam accumulation Fc toward the exit side of the application nip N by rotating the application roller 61 and the pressure roller 62 while monitoring the foam accumulation Fc by checking the foam accumulation detecting signal generated by the optical foam accumulation sensor 450. The foam fixer F transferred to the exit side of the application nip N is then collected by the application roller cleaning blade 63 or the pressure roller cleaning blade 64.

When the pressure applied by the pressure roller 62 is released, the cam configuration is arranged such that an approximately 1 mm gap is provided between the application roller 61 and the pressure roller 62 for facilitating the foam fixer F forming the foam accumulation Fc to be transferred toward the exit side of the application nip N. With such a configuration, the foam fixer F forming the foam accumulation Fc may be transferred faster toward the exit side of the application nip N. Further, the rotational speeds of the application roller 61 and the pressure roller 62 may be increased for further accelerating the transfer of the foam accumulation Fc formed of the foam fixer F toward the exit side of the application nip N by controlling the driving of the application roller driving motor M1 and the pressure roller driving motor M2 while the foam accumulation removal operation is performed.

Note that since the application roller 61 and the pressure roller 62 are in contact with each other while the foam accumulation removal operation is performed in the first embodiment, the application roller 61 and the pressure roller 62 may need to have an equal surface moving speed. However, since the application roller 61 and the pressure roller 62 are detached from each other while the foam accumulation removal operation is performed in the second embodiment, the application roller 61 and the pressure roller 62 may have different surface moving speeds.

When the fixing device CPU 700 performs the foam accumulation removal operation and detects the "no foam accumulation" state, the fixing device CPU 700 deactivates the driving of the application roller driving motor M1 and the pressure roller driving motor M2, transmits an activation signal to the cam driving motor M7, and initiates the driving of the cam driving motor M7 to rotate the pressure roller detaching cam 80 in a direction opposite to the direction when the pressure is released. In this process, a change in the position of the pressure roller detaching cam 80 in the rotational direction may be detected by causing the cam position sensor S3 (see FIG. 9) to detect the position of the cam position detecting filler 83 in the rotational direction. Accordingly, the fixing device CPU 700 may drive the cam driving motor M7 until the bearing 621 of the pressure roller 62 engages the pressure position 80*a* of the pressure roller detaching cam 80 while monitoring the change in the position of the pressure roller detaching cam 80.

It may be possible to reduce the rotational time to rotate the pressure roller detaching cam 80 until the bearing 621 moves from the detaching position 80*b* to the pressure position 80*a* of the pressure roller detaching cam 80 by rotating the pressure roller detaching cam 80 in the direction opposite to the direction when the pressure is released.

When the pressure roller detaching cam 80 rotates to a position where the bearing 621 engages the pressure position 80*a*, the fixing device CPU 700 finishes the foam accumulation removal operation and returns to control the normal operation.

Further, on detecting the "no foam accumulation" state, the fixing device CPU 700 reports the "no foam accumulation" state to the copier main body CPU 750 via the IF communication connection section 730. On receiving the report indicating the "no foam accumulation" state, the copier main body CPU 750 turns ON the sheet transfer clutch 470 to restart the normal printing operation.

In the fixing device 60 according to the second embodiment, the copier main body CPU 750 explicitly reports to the operator via the operations panel 751 or the monitor of the personal computer (PC) that the foam accumulation removal operation is currently being conducted in the copier 100 main body while the foam accumulation removal operation is being performed in a manner similar to the fixing device 60 according to first embodiment.

Note that the fixing device CPU 700 regularly checks the foam accumulation detecting signal per transfer of the transfer sheet P (i.e., between the transfers of the two transfer sheets P) in the same manner as the fixing device 60 according to the first embodiment.

Further, in the fixing device 60 according to the first embodiment, the fixing device CPU 700 sets the application length of the micro-bubble foam fixer Fb in the timer 710 based on information on the linear velocity and the size of the transfer sheet P provided by the copier main body CPU 750 to control the application time of the micro-bubble foam fixer Fb.

However, since the transfer sheet P that has passed through the application nip N is not actually detected, the margin is required for performing the paper jamming fixation or the foam accumulation operation. Thus, a timer times the rotational time of the application roller 61 and the pressure roller 62 corresponding to the linear velocity and the size of the transfer sheet P. This may complicate the control program of the fixing device 60.

Thus, the fixing device 60 according to the second embodiment includes a sheet rear end sensor S2 configured to detect a rear end of the transfer sheet P that has passed through the application nip N and arranged downstream of the application nip N in the transfer direction of the transfer sheet P. The sheet rear end sensor S2 detects the rear end of the last transfer sheet P remaining in the transfer path that has passed through the application nip N before the foam accumulation removal operation is performed, and the pressure applied by the pressure roller 62 is released from the application roller 61 after the detection of the rear end of the last transfer sheet P that has passed through the application nip N. With this configuration, the pressure roller 62 and the application roller 61 may be reliably detached after the transfer sheet P in the transfer path has passed through the application nip N. Thus, the image formed on the transfer sheet P may be prevented from degradation immediately before the foam accumulation removal operation is performed. Specifically, when the foam fixer is applied over the entire surface of the transfer sheet, the amount of the foam fixer applied may be controlled to the minimum. Accordingly, the application time management timer value for each size of the transfer sheet P may not be required, thereby facilitating the control program of the fixing device 60.

Further, the fixing device 60 according to the second embodiment may further include a function of a discharging sheet jamming sensor by combining the detected results of the sheet front end sensor S1 and the sheet rear end sensor S2.

In the fixing device 60 according to the first and second embodiments, the application roller 61 and the pressure roller 62 are formed of roller members provided as a fixer application member and a facing member facing the fixer application member; however, the fixer application member and the facing member may not be formed of the roller members. One of the fixer application member and the facing member may be formed of an endless belt member configured to travel endlessly.

As described above, the fixing device 60 according to the first and second embodiments includes the foam fixer generator section 500 and the application roller 61. The foam fixer generator section 500 is used as a foam fixer generator unit configured to generate a foam fixer F formed of the liquid fixer TL having dispersed bubbles. Specifically, the foam fixer F is formed by introducing air bubbles into the liquid fixer TL containing a softener capable of softening toner by dissolving or swelling part of resin particles of the toner composed of resin particles to generate the foam fixer F. The application roller 61, which is the fixer application member configured to be brought into contact with the pressure roller 62 used as a facing member of the application roller 61 to form the application nip N, transfers the micro-bubble foam fixer Fb generated by the foam fixer generator section 500 to the application nip N by the surface movement of the application roller 61, and applies the micro-bubble foam fixer Fb over the surface of the transfer sheet P used as a recording medium that carries resin particles at the application nip N. In the fixing device 60, the foam fixer F is applied to toner to fix the toner on the transfer sheet P. The fixing device 60 further includes the foam accumulation sensor used as a foam accumulation detector unit configured to detect foam accumulation Fc that is a foam fixer F accumulated at the entrance side of the application nip N. With the fixing device 60 having such a configuration, the fixing operation is carried out after the determination of whether the foam accumulation Fc is present at the entrance side of the application nip N. Thus, defects due to the image fixation carried out with the presence of the foam accumulation Fc may be suppressed.

In the fixing device according to the first embodiment, the fixer is a conductive liquid, the foam accumulation sensor is the contact-type foam accumulation sensor 400 configured to include two electrode members (i.e., first upper electrode 410*a* and second upper electrode 410*b* or first lower electrode 420*a* and second lower electrode 420*b*) arranged at the positions where the foam accumulation Fc is formed such that the presence or absence of the foam accumulation Fc is detected based on whether the two electrode members are electrically conducted. Accordingly, the foam accumulation may be detected by the electric conductivity generated between the two electrode members.

Further, in the fixing device 60 according to the second embodiment, the foam accumulation sensor employed is the non-contact type optical foam accumulation sensor 450. Since the optical foam accumulation sensor 450 provided in the fixing device 60 according to the second embodiment is non-contact type, the foam accumulation sensor may be arranged in a distance from the positions where the foam accumulation Fc is formed, thereby securing the reliability in the foam accumulation detection conducted by the foam accumulation sensor.

In the fixing device according to the first and second embodiments, the foam accumulation removal operation to remove the foam accumulation Fc is based on a detected result obtained by one of the foam accumulation sensors 400 and 450. Accordingly, defects due to the foam accumulation Fc formed at the entrance side of the application nip N may be suppressed.

Further, the foam accumulation removal operation in the fixing device 60 according to the first embodiment is carried out by driving the application roller driving motor M1 and the pressure roller driving motor M2 to move the application roller 61 and the pressure roller 62 surfaces that form the application nip N while the application of the micro-bubble foam fixer Fb from the die-coater head 501 to the surface of the application roller 61 is suspended. While the application of the micro-bubble foam fixer Fb from the die-coater head 501 to the surface of the application roller 61 is being suspended, the foam accumulation removal operation may be carried out by simply moving the application roller 61 and the pressure roller 62 surfaces until the fixing device CPU 700 detects the "no foam accumulation" state.

Further, the foam accumulation removal operation in the fixing device 60 according to the second embodiment is carried out by causing the pressure roller detaching mechanism to detach the pressure roller 62 from the application roller 61 and then driving the application roller driving motor M1 and the pressure roller driving motor M2 to move the application roller 61 and the pressure roller 62 surfaces that form the application nip N while the application of the micro-bubble foam fixer Fb from the die-coater head 501 to the surface of the application roller 61 is suspended. While the pressure roller 62 is detached from the application roller 61 and the application of the micro-bubble foam fixer Fb from the die-coater head 501 to the surface of the application roller 61 is being suspended, the foam accumulation removal operation may be carried out faster than the fixing device 60 according to the first embodiment by simply moving the application roller 1 and the pressure roller 62 surfaces until the fixing device CPU 700 detects the "no foam accumulation" state. With this configuration, the foam fixer F foaming the foam accumulation Fc may be easily passed through the application nip N due to the pressure roller 62 being detached from the application roller 61.

Further, in the fixing device according to the first and second embodiments, the surface moving speeds of the application roller 61 and the pressure roller 62 while the foam accumulation removal operation is performed may be controlled such that the surface moving speeds of the application roller 61 and the pressure roller 62 are faster than the surface moving speeds of the application roller 61 and the pressure roller 62 while the fixing operation is performed. Accordingly, the foam accumulation removal operation may be performed at high speeds.

Thus, the fixing device 60 according to the second embodiment includes the sheet rear end sensor S2 provided as a sheet rear end detector unit configured to detect the rear end of the transfer sheet P that has passed through the application nip N and arranged downstream of the application nip N in the transfer direction of the transfer sheet P, and the application roller 61 applies the micro-bubble foam fixer Fb to the transfer sheet P that has passed through the application nip N. With this configuration, the pressure applied by the pressure roller 62 to the application roller 61 may be released after the detection of the rear end of the transfer sheet P that has passed through the application nip N. Further, when the foam fixer is applied over the entire surface of the transfer sheet, the amount of the foam fixer applied may be controlled to the minimum. Accordingly, the application time management timer value for each size of the transfer sheet P may not be required, thereby facilitating the control of the fixing device 60. Moreover, the fixing device 60 according to the second embodiment may further include the function of the discharging sheet jamming sensor by combining the detected results of the sheet front end sensor S1 and the sheet rear end sensor S2.

In addition, the copier 100 according to the first and second embodiments includes a printer section 1 used as a toner image forming unit configured to form the toner image on the transfer sheet P used as a recording medium by utilizing toner containing resin particles composed of resin and colorant; and a fixing unit configured to provide the foam fixer F on the surface of the transfer sheet P carrying the toner image to fix the toner image on the transfer sheet P. With this configuration, since the fixing device 60 according to the first or second embodiment is used as the above fixing unit, the defects due to the foam accumulation Fc may be suppressed, thereby reliably fixing the toner image on the transfer sheet P.

Further, in the copier 100 according to the first and second embodiments, when the fixing device CPU 700 detects the "foam accumulation Fc" state, the fixing device CPU 700 transmits the foam accumulation Fc signal to the copier main body CPU 750 that is a control section of the image forming apparatus main body (i.e., copier 100 main body). With this configuration, the information on the presence or absence of the foam accumulation Fc may be shared between the fixing device CPU 700 and the copier main body CPU 750.

Moreover, in the copier 100 according to the first and second embodiments, after the fixing device CPU 700 transmits the foam accumulation Fc signal to the copier main body CPU 750, the fixing device CPU 700 may detect the "no foam accumulation Fc" state. When the fixing device CPU 700 detects the "no foam accumulation Fc" state, the fixing device CPU 700 transmits a no foam accumulation Fc signal to the copier main body CPU 750. With this configuration, the copier main body CPU 750 may be reliably informed of the no foam accumulation Fc information and restart the operation of the copier 100 that has been suspended due to the presence of the foam accumulation Fc.

Further, in the copier 100 according to the first and second embodiments, since the supply of the transfer sheet P from the sheet cassettes 42 to the printer section 1 is temporarily stopped between the time when the copier main body CPU 750 receives the foam accumulation Fc signal and the time when the copier main body CPU 750 receives the no foam accumulation Fc signal. Accordingly, a new transfer sheet P may be prevented from being supplied toward the application nip N where the foam accumulation Fc is formed, and the foam accumulation removal operation may be performed without having the transfer sheet P supplied into the application nip N.

Moreover, in the copier 100 according to the first and second embodiments, the foam accumulation sensor of the fixing device 60 carries out a foam accumulation detecting operation between the transfers of the transfer sheets P on which the image forming operation is carried out, and carries out the foam accumulation removal operation after the transfer sheets P fed inside the printer section 1 are externally discharged from the copier 100. With this configuration, since the foam accumulation Fc is detected between the transfers of the transfer sheets P and the foam accumulation removal operation is carried out after each print job, the adverse effect on the image formation due to the foam accumulation removal operation may be reduced.

Further, in the copier 100 according to the first and second embodiments, the foam accumulation removal operation to remove the foam accumulation Fc may be carried out based on the detected result obtained by the foam accumulation sensor every time an image forming operation has been carried out on a predetermined number of transfer sheets. That is, when the foam accumulation Fc is detected between the transfers of the transfer sheet P to determine that the print job needs a longer time to be carried out, the foam accumulation removal operation may be periodically carried out (i.e., the foam accumulation removal operation may be carried out after the predetermined number of transfer sheets P, at the time print job is completed, or while initializing operation is carried out when power is supplied). Thus, defects due to the foam accumulation Fc formed at the entrance side of the application nip N may be more reliably suppressed in the above-described manner.

Further, the copier 100 according to the first and second embodiments includes the operations panel 751 or the monitor of the personal computer (PC) as a reporting unit configured to report to the operator via the monitor of the personal computer (PC) that the image forming operation is currently interrupted and temporarily stopped while the foam accumulation removal operation is carried out in the copier 100 main body. This may prevent the operator from misconceiving the interruption of the image forming operation as the malfunction of the copier 100.

According to the first and second embodiments, since the foam accumulation detector unit detects the foam accumulation accumulated at the entrance side of the application nip, the fixing operation is carried out after the determination of whether the foam accumulation is present at the entrance side of the application nip. Thus, defects due to the image fixation carried out with the presence of the foam accumulation may be suppressed.

Embodiments of the present invention have been described heretofore for the purpose of illustration. The present invention is not limited to these embodiments, but various variations and modifications may be made without departing from the scope of the present invention. The present invention should not be interpreted as being limited to the embodiments that are described in the specification and illustrated in the drawings.

The present application is based on Japanese Priority Application No. 2010-047844 filed on Mar. 4, 2010, with the Japanese Patent Office, the entire contents of which are hereby incorporated by reference.

What is claimed is:

1. A fixing device for fixing resin particles softened by applying a foam fixer thereon to a recording medium, the fixing device comprising:

a foam fixer generator unit configured to introduce air bubbles into a liquid fixer containing a softener for softening the resin particles by dissolving or swelling a part of the resin particles to generate the foam fixer;

a fixer application member configured to be brought into contact with a facing member facing the fixer application member to form an application nip therebetween, and transfer the foam fixer generated by the foam fixer generator unit to the application nip by moving a surface thereof while carrying the foam fixer on the surface thereof to apply the foam fixer to a surface of the recording medium carrying the resin particles or a surface of a resin particle carrying member carrying the resin particles at the application nip; and a foam accumulation detector unit configured to detect a foam accumulation formed of the foam fixer accumulated at an entrance side of the application nip.

2. The fixing device as claimed in claim 1, wherein the liquid fixer is a conductive liquid, and the foam accumulation detector unit includes two electrode members arranged at respective positions where the foam accumulation is formed to detect a presence or an absence of the foam accumulation based on whether the two electrode members are electrically conductive.

3. The fixing device as claimed in claim 1, wherein the foam accumulation detector unit is a non-contact sensor.

4. The fixing device as claimed in claim 1, wherein a foam accumulation removal operation to eliminate the foam accumulation formed of the foam fixer accumulated at the entrance side of the application nip is carried out based on a detected result obtained by the foam accumulation detector unit.

5. The fixing device as claimed in claim 4, wherein the foam accumulation removal operation includes moving respective surfaces of the fixer application member and the facing member that form the application nip while application of the foam fixer to the surface of the fixer application member is suspended.

6. The fixing device as claimed in claim 4, wherein the foam accumulation removal operation includes detaching the facing member from the fixer application member, and moving the surfaces of the fixer application member and the facing member that form the application nip while the application of the foam fixer to the surface of the fixer application member is suspended.

7. The fixing device as claimed in claim 4, wherein speeds of moving the surfaces of the fixer application member and the facing member while the foam accumulation removal operation is carried out are increased to be higher than speeds of moving the surfaces of the fixer application member and the facing member while a fixing operation is carried out to fix the resin particles softened by applying the foam fixer thereon to the surface of the recording medium carrying the resin particles.

8. The fixing device as claimed in claim 1, further comprising:

a rear end detector unit configured to detect a rear end of the recording medium that has passed through the application nip, wherein a fixer application target to which the foam fixer is applied by the fixer application member is the recording medium that has passed through the application nip.

9. An image forming apparatus comprising:

a toner image forming unit configured to form a toner image on a surface of a recording medium by utilizing toner containing resin particles composed of resin and colorant; and the fixing device as claimed in claim 1 employed as a fixing unit configured to apply a foam fixer on the surface of the recording medium that carries the toner image to fix the toner image thereon.

10. The image forming apparatus as claimed in claim 9, wherein when the foam accumulation detector unit of the fixing device detects a presence of the foam accumulation, a control section of the fixing device transmits a signal indicating that the foam accumulation has been detected to a control section of the image forming apparatus main body.

11. The image forming apparatus as claimed in claim 10, wherein when the foam accumulation detector unit of the fixing device detects an absence of the foam accumulation after the control section of the fixing device has transmitted the signal indicating that the foam accumulation has been detected to the control section of the image forming apparatus main body, the control section of the fixing device transmits a signal indicating that no foam accumulation has been detected to the control section of the image forming apparatus main body.

12. The image forming apparatus as claimed in claim 11, wherein the control section of the image forming apparatus main body suspends feeding of the recording medium to the toner image forming unit in a period between a time where the control section of the image forming apparatus main body has received the signal indicating that the foam accumulation has been detected and a time where the control section of the image forming apparatus main body receives the signal indicating that no foam accumulation has been detected.

13. The image forming apparatus as claimed in claim 9, wherein the foam accumulation detector unit of the fixing device carries out a foam accumulation detection operation to detect the foam accumulation between a first transfer and a second transfer of first and second recording media on which an image forming operation is carried out, and the foam accumulation removal operation is carried out based on a detected result obtained by the foam accumulation detector unit after the first and second recording media fed inside the image forming apparatus have been externally discharged.

14. The image forming apparatus as claimed in claim 9, wherein the foam accumulation removal operation is carried out based on a detected result obtained by the foam accumulation detector unit for every predetermined number of the recording media on which an image forming operation has been carried out.

15. The image forming apparatus as claimed in claim 9, further comprising:

a reporting unit configured to report that an image forming operation is temporarily stopped while the foam accumulation removal operation is carried out based on a detected result obtained by the foam accumulation detector unit of the fixing device.

* * * * *